US012715635B2

(12) United States Patent
Bartoli et al.

(10) Patent No.: US 12,715,635 B2
(45) Date of Patent: Aug. 25, 2026

(54) PLANT FOR PROCESSING CAPSULES FOR BEVERAGES

(71) Applicant: Sarong Societa' Per Azioni, Reggiolo (IT)

(72) Inventors: Andrea Bartoli, Reggio Emilia (IT); Alberto Bartoli, Quattro Castella (IT)

(73) Assignee: I.M.A. INDUSTRIA MACCHINE AUTOMATICHE S.P.A., Bologna (IT)

( * ) Notice: Subject to any disclaimer, the term of this patent is extended or adjusted under 35 U.S.C. 154(b) by 548 days.

(21) Appl. No.: 17/438,243

(22) PCT Filed: Mar. 13, 2020

(86) PCT No.: PCT/IB2020/052310

§ 371 (c)(1),
(2) Date: Sep. 10, 2021

(87) PCT Pub. No.: WO2020/183430

PCT Pub. Date: Sep. 17, 2020

(65) Prior Publication Data

US 2022/0185518 A1 Jun. 16, 2022

(30) Foreign Application Priority Data

Mar. 13, 2019 (IT) ..... 102019000003631

(51) Int. Cl.
*B65B 7/01* (2006.01)
*B65B 29/02* (2006.01)
(Continued)

(52) U.S. Cl.
CPC ..... *B65B 29/022* (2017.08); *B65B 7/01* (2013.01); *B65B 43/52* (2013.01); *B65B 59/04* (2013.01)

(58) Field of Classification Search
CPC ..... B65B 29/022; B65B 29/025; B65B 43/42; B65B 43/52; B65B 43/54; B65B 43/56;
(Continued)

(56) References Cited

U.S. PATENT DOCUMENTS

2008/0299262 A1* 12/2008 Reati ..... B65B 61/20 83/84
2014/0138212 A1* 5/2014 van de Loecht ..... B65G 54/02 198/461.1
(Continued)

FOREIGN PATENT DOCUMENTS

DE 102016212227 A1 1/2018
EP 0475827 A1 3/1992
(Continued)

OTHER PUBLICATIONS

International Search Report and Written Opinion of the Interantional Searching Authority; Application No. PCT/IB2020/052310; Completed: May 19, 2020; Mailing Date: Jul. 28, 2020; 17 Pages.

*Primary Examiner* — Linda J. Hodge
(74) *Attorney, Agent, or Firm* — Whitmyer IP Group LLC

(57) ABSTRACT

A plant for processing capsules for preparing beverages includes at least one rail along which a plurality of processing stations is arranged for the capsules, in each of which on each capsule preset processing is performed, in which conveying elements, each of which conveys a capsule, are movable along the rail, each conveying element being movable along the rail independently of the other conveying elements. A method for processing capsules for preparing beverages, in a processing plant for processing capsules for beverages including at least one rail along which a plurality of processing stations is arranged for the capsules, in each of which on each capsule preset processing is performed, wherein conveying elements, each of which conveys a capsule, are movable along the rail; the movement speed of
(Continued)

each conveying element is adjustable independently of the movement speed of the other conveying elements and the gap between two adjacent conveying elements, during the motion of the conveying elements, can be adjusted independently of the gap between other conveying elements that are adjacent to one another.

24 Claims, 16 Drawing Sheets

(51) Int. Cl.
*B65B 43/52* (2006.01)
*B65B 59/04* (2006.01)

(58) Field of Classification Search
CPC . B65B 65/003; B65B 65/006; B65B 2210/02; B65B 1/02; B65B 7/01; B65G 54/02; B65G 57/04; B65G 23/28
USPC ..... 198/690.1
See application file for complete search history.

(56) References Cited

U.S. PATENT DOCUMENTS

2014/0190863 A1* 7/2014 Fabozzi ..... B65B 29/022 206/524.6
2014/0202120 A1* 7/2014 Scrivani ..... B65B 1/12 53/558
2016/0144987 A1* 5/2016 Scrivani ..... B65B 7/01 53/487
2016/0176555 A1* 6/2016 Castellari ..... B65B 35/02 53/167
2016/0376105 A1* 12/2016 Raffaini ..... B65G 54/02 198/604
2017/0327254 A1* 11/2017 Cerati ..... B65B 29/022
2018/0002104 A1* 1/2018 Moura De Castro Gandra ..... B65D 85/8043
2018/0111710 A1* 4/2018 Choplin ..... B65B 35/16
2019/0077529 A1* 3/2019 Baraccani ..... B65B 35/16
2019/0233152 A1* 8/2019 Nakamoto ..... B65B 51/32
2020/0002040 A1* 1/2020 von Birgelen ..... B65G 23/23
2020/0253413 A1* 8/2020 Orler ..... A47J 31/407
2021/0253336 A1* 8/2021 Tottone ..... B65D 85/8067

FOREIGN PATENT DOCUMENTS

EP 2420450 A1 * 2/2012 ..... B65B 3/003
EP 3045399 A1 7/2016
EP 3281879 A1 * 2/2018 ..... B65B 1/30
IT T102015000070588 11/2015
WO 2013093763 A1 6/2013

* cited by examiner

F6
2c
3
3
3
F6
22
23
2a
1a
3
25
3
3
F5
17
F6

3
26
2
3
2a
3
F7
20
27
3
3
2b
F6

PLANT FOR PROCESSING CAPSULES FOR BEVERAGES

TECHNICAL FIELD

The invention relates to a plant for processing capsules for beverages, i.e. capsules intended to contain a product by which a beverage can be prepared, like, for example, coffee, tea, or other beverages, in which the capsules are conveyed along the plant by a magnetic conveying system.

BACKGROUND

The plant according to the invention can be used to shear and insert a closing element for closing the bottom of the capsule and a filter inside the previously formed body of a capsule for beverages, for example by thermoforming a sheet of plastics, or by drawing a sheet of aluminium, or from a sheet of multilayered laminate comprising at least one layer of aluminium, or by injection moulding.

The plant according to the invention can also be used to perform the operations of filling the capsule with a product for preparing a beverage, replacing the air inside the capsule with an inert gas, shearing a closing element for closing the capsule from a film of closing material and welding the closing element to the body of the capsule.

In known plants for processing capsules, the bodies of the capsules are conveyed to the various stations of the plant by conveying elements, each of which is provided with a plurality of seats, each of which can receive the body of a capsule, in which the seats are arranged in rows oriented perpendicular or parallel to the conveying direction of the capsules. The conveying elements are moved along the plant for example by a mechanical conveying device, for example by a chain conveying device, with an indexed movement.

In each station of a plant for processing capsules, the processing time, i.e. the time required to perform a given task on the capsule, for example filling the capsule, or shearing and welding of the closing film, etc., may be different from that of the other stations, whereas the movement speed of each conveying element and the number of capsules in each transport element is constant, i.e. all the conveying elements move at the same speed, which corresponds to the conveying speed of the capsules along the plant.

This all means that the productivity of the plant is affected by the processing station, which requires a longer processing time, because as all the slat conveyors have the same conveying speed, it is not possible to differentiate between the speed of the individual slat conveyors in order to take account of the different processing times in the different stations, and thus the movements of a slat conveyor between one processing station and the next can occur only at intervals of time that are equal to the processing time of the station that requires the longest processing time.

Further, all the processing stations must have the same number of operating elements, which is the same as the number of capsules of each conveying element or groups of adjacent conveying elements, which makes it impossible to optimize the processing stations with reference to the number of operating units in each station and to the cycle time of each station.

SUMMARY

The present invention proposes providing a method and a plant for processing capsules in which conveying each capsule, or groups of capsules, can occur at a different speed and in different modes from the conveying speed and modes of the other capsules or groups of capsules, so as to be able to optimize conveying of the capsules along the entire plant, without being constrained by the processing time of the station that requires the longest processing time.

A further object of the present invention is to optimize the size of the processing stations of the plant with reference to the number of operating units in each station.

Another object of the invention is to minimize the overall dimensions of a processing plant for processing capsules for beverages and to make configuration of the plant as simple as possible, with the further possibility of changing configuration rapidly and being able to extend the plant at will simply and relatively cheaply.

A still further object of the invention is to optimize the management of the gaps between the capsules in function of the structure and the operating needs of each processing station and each processing step.

Another object of the present invention is to be able to perform simultaneously in the same plant different types of processing on capsules of different type, like, for example, capsules for coffee powder, or capsules for soluble coffee.

The objects of the invention are achieved with a method for processing capsules for beverages and by a plant for processing beverages in accordance with the invention.

The invention makes it possible to manage flexibly a plant for processing capsules for beverages, optimizing the productivity of the plant, owing to the fact that the single capsules can each be moved independently of one another along the entire plant, with the possibility of varying the movement speed of the single capsules and the gaps between the capsules, so as to adapt the movement modes of the capsules to the structure and the operating modes of the single processing stations arranged along the plant.

The invention further makes it possible to optimize the dimensions of the processing stations, choosing for each station the most suitable number of operating units on the basis of the processing to be performed and the time required for said processing.

The invention also makes it possible to combine together two plants with stations configured for different processing, inasmuch as it is possible to transfer directly and automatically the capsules from one plant to the other without downtime and without having to vary the speed of the capsules in the transfer between the two plants.

Lastly, the invention makes it possible to perform simultaneously in the same plant processing of different type on capsules of different type.

Further, the invention enables the configuration of the plant to be modified simply and rapidly and to be expanded at will.

BRIEF DESCRIPTION OF THE DRAWINGS

Further features and advantages of the invention will emerge from the description that follows of some embodiments of the invention, with reference to the enclosed drawings, in which.

DETAILED DESCRIPTION

Figure 1:
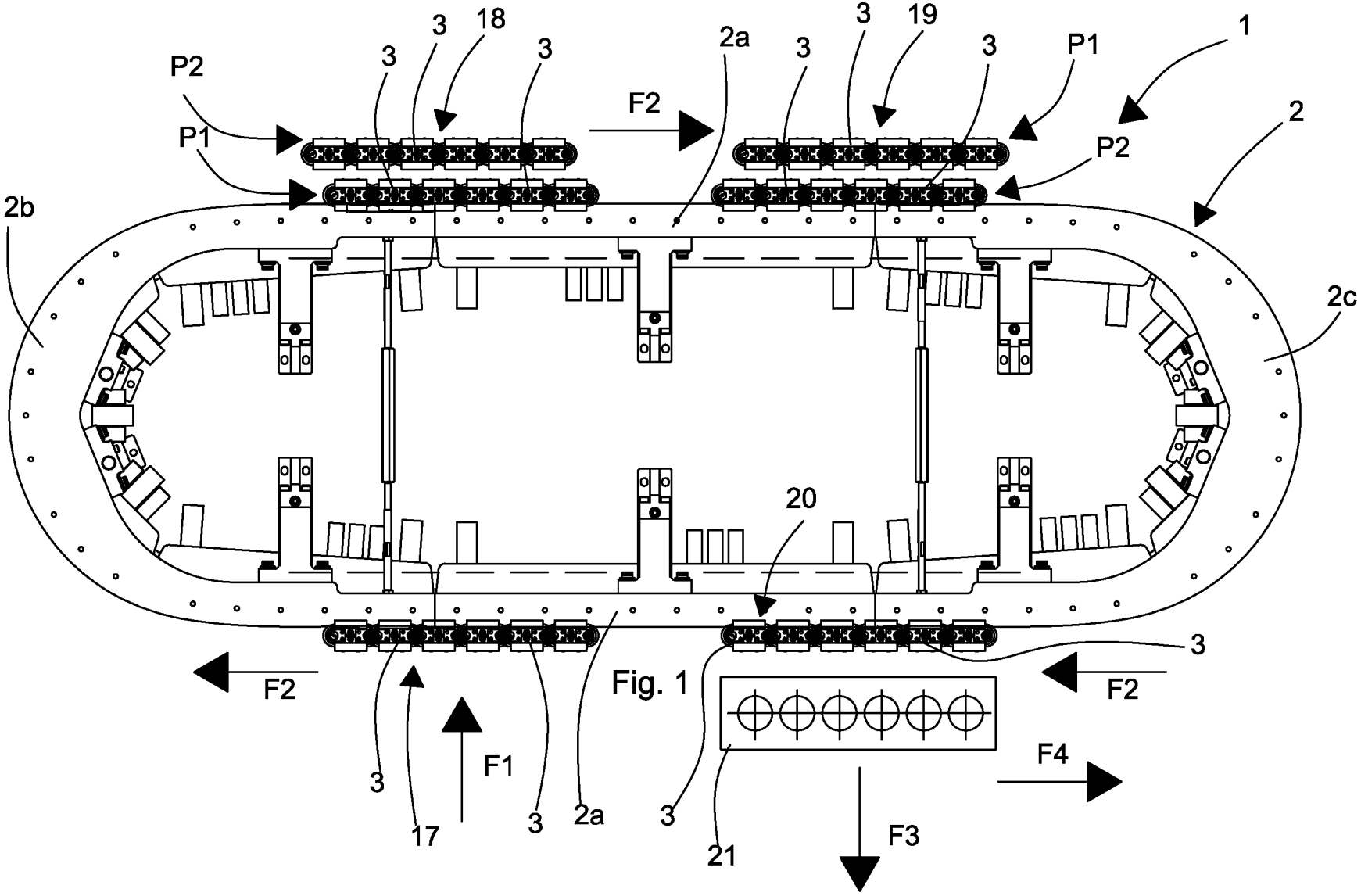
FIG. 1 is a schematic plan view of a first embodiment of a processing plant for processing capsules for beverages according to the invention, with magnetic conveying of the capsules along the plant.

In FIG. 1, a first embodiment of a plant 1 according to the invention for processing capsules for preparing beverages is illustrated.

In this first embodiment, the plant 1 is configured for inserting inside each capsule an aluminium closing element and a filter.

Figure 5:
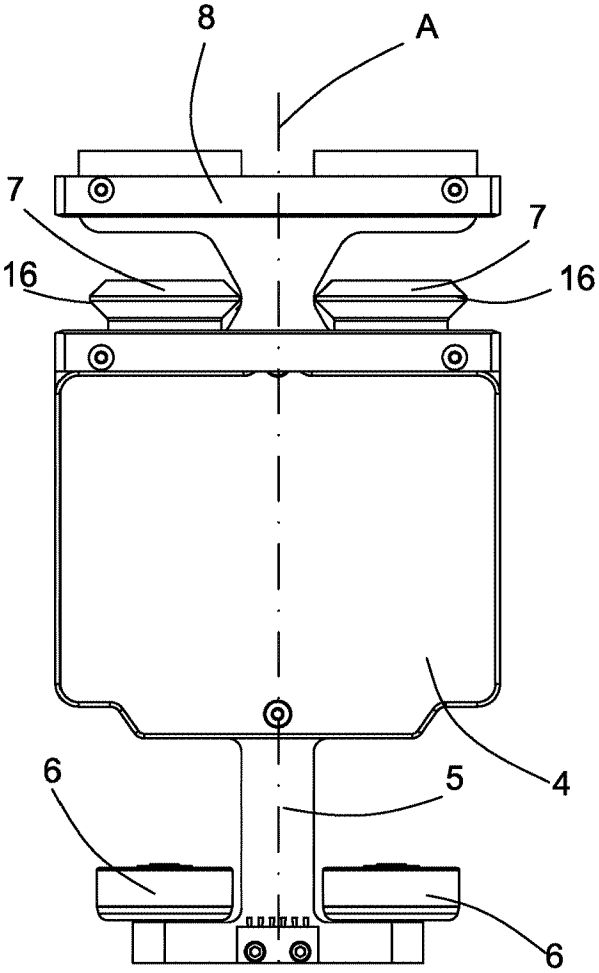
FIG. 5 is a front view of a conveying element for conveying the capsules for beverages in the processing plants for processing capsules for beverages according to the invention, illustrated in FIGS. 1, 2, 3 and 4.
Figure 7:
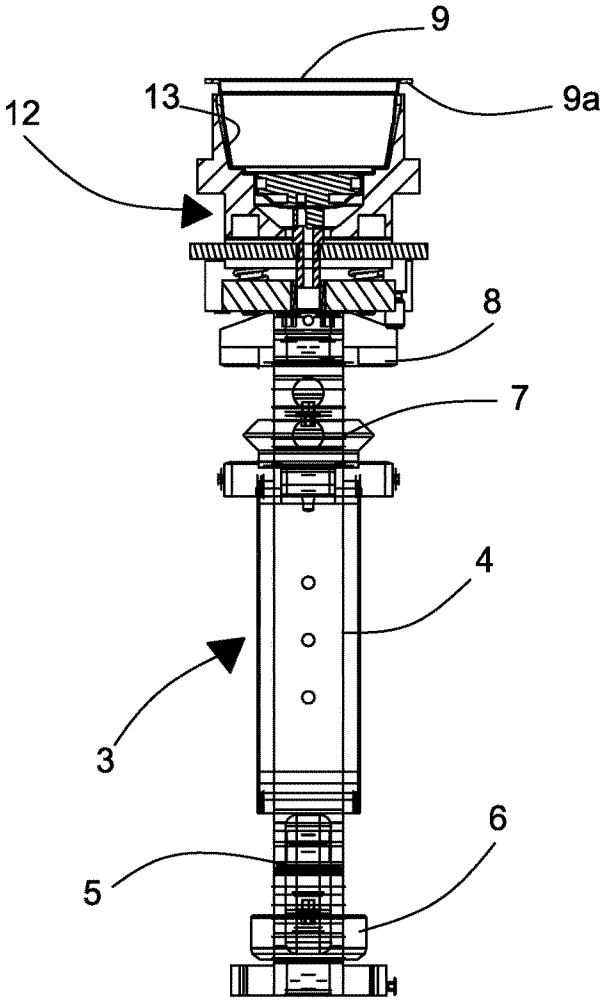
FIG. 7 is a side view of the conveying element, like the one in FIG. 6, in which on the conveying element a capsule-holding element has been installed into which a capsule for beverages has been inserted.

The plant 1 comprises a magnetic conveying system, which operates according to the principle of the linear electric motor and comprises a loop-shaped rail 2, along which conveying elements 3 (FIG. 5) are slidable, each of which is able to convey at least one respective capsule 9 (FIG. 7). The rail 2 comprises two rectilinear portions 2*a* that are parallel to one another, connected by two curvilinear portions 2*b*, 2*c*.

The loop-shaped rail 2 is so arranged that the conveying elements 3 move along all said rail in a direction parallel to a horizontal plane, in which a horizontal plane is understood to be a plane that is perpendicular to the direction of the force of gravity.

The rail 2 can comprise a plurality of rectilinear and curvilinear portions, in which the curvilinear portions can have a differing angular size, which enables different configurations of the rail to be obtained, depending on production needs and the space available for the plant.

The conveying element 3 is provided with a body 4 that has a lower appendage 5 to which a pair of first revolving elements 6 are fixed, which are arranged symmetrically with respect to an axis of symmetry A of the conveying element 3 and are free to rotate around a respective axis of rotation parallel to said axis of symmetry A.

The body 4 is provided above with at least one pair of further revolving elements 7 the lateral faces of which both have a section of substantially triangular shape.

The body 4 ends above in a resting element 8, to which a support element 12 can be fitted, provided with a cavity 13 configured so as to be able to receive a capsule 9, provided with a flange-shaped edge 9*a*. The support element 12 is interchangeable so that it is possible to fit support elements 12 that are suitable for receiving capsules of different formats to the conveying element 3. This permits maximum ease of management of a change of format of the capsules being processed, or replacing on the conveying elements 3 the support elements 12 with other support elements 12 for the new format of capsules, or replacing on the rail 2 the conveying elements 3 with other conveying elements 3 equipped with supports 12 for the new format of capsules. In this case, the other conveying elements 3 can be prepared on a non-operational plant branch, substantially a parking branch of the conveying elements 3, from which to deliver automatically, upon request, into the operating zone of the plant, the conveying elements 3 equipped with the supports 12 for the new format of capsules. The rail 2 is provided with a metal core 15, on which electrical windings are arranged that are so configured that when they are supplied with alternating current they generate a magnetic field that moves along the rail 2 at a movement speed that can be adjusted by adjusting the intensity of the current in the electric windings.

The rail 2 is provided below with a rest surface 10, against which the first revolving elements 6 rest whilst the conveying element 3 moves along the rail 2.

One face 14 of the body 4 is provided with at least one permanent magnet that, owing to the interaction between the magnetic field thereof with the metal of the core 15 of the rail 2 enables the support element 3 to adhere to the rail 2 and be maintained adhering thereto. Further, the interaction between the magnetic field of the permanent magnet and the movable magnetic field generated by the windings of the core 15 enables the support element 3 to be moved along the rail 2 at an adjustable speed by varying the intensity of the current in the windings of the core 15.

The rail 2 is provided with at least one guide groove 11, in which the second revolving elements 7 are inserted, when the conveying element 3 is fitted to the rail 2. The at least one guide groove 11 has a shape that is complementary to the shape of the side faces 16 of the second revolving elements 7.

The plant 1 according to the invention is provided along the rail 2 with a plurality of processing stations:

an inlet station 17 into which the capsules 9 coming from a direction F1, for example substantially perpendicular to the rail 2, are inserted, by an insertion device, which is not illustrated, into respective conveying elements 3 waiting in the first station 17;

a first shearing and welding station 18 in which from a sheet of aluminium or of a multilayered material comprising at least one layer of aluminium, closing discs are sheared, one for each capsule 9, which are subsequently inserted into the respective capsules 9 and welded on the bottom thereof;

a second shearing and welding station 19 in which disc-shaped filters are sheared from a sheet of filter material, one for each capsule 9, which are subsequently inserted into the respective capsules 9 and welded in the inside thereof;

an outlet station 20 in which the capsules 9 are removed from the respective conveying elements 3 by a removing device, which is not shown, and are inserted into a control device 21 configured for checking whether the capsules have possible defects.

The capsules 9 that are free of defects are removed from the control device 21 and moved away along a direction F3, for example perpendicular to the rail 2, to be directed to possible further processing.

The capsules 9 that have defects are also removed from the control device 21 and directed to a collection point along a direction F4, that can be parallel to the direction F3 or divergent from the direction F3, for example parallel to the rail 2.

The conveying elements 3, with the respective capsules 9, move along the rail 2, in the direction of the arrows F2.

The conveying elements 3, with the respective capsules 9 can be moved along the rail 2 in both directions, each conveying element 3 can be moved along the rail 2 at a different speed from that of the other conveying elements and independently of the other conveying elements. The conveying elements can also be moved in groups along the rail 2, the number of capsules 9 of each group depends on the number of operating elements in each processing station. For example, if in the first shearing and welding station 18 and in the second shearing and welding station 19 there are six shearing and welding heads, the conveying elements 3 with the respective capsules 6 are moved along the rail 2 in groups of 6.

The possibility of managing the method of moving each conveying element 3 independently of the method of moving the other conveying elements 3 enables the gap to be optimized between the capsules 9, i.e. between the conveying elements 3, and the capsules to be grouped freely, according to the structure of each processing station, and the time required for each processing step. Consequently, the structure of each processing station can be chosen freely so as to optimize the number of operating elements in each station, on the basis of the time requested by each processing step in the various stations.

Figure 2:
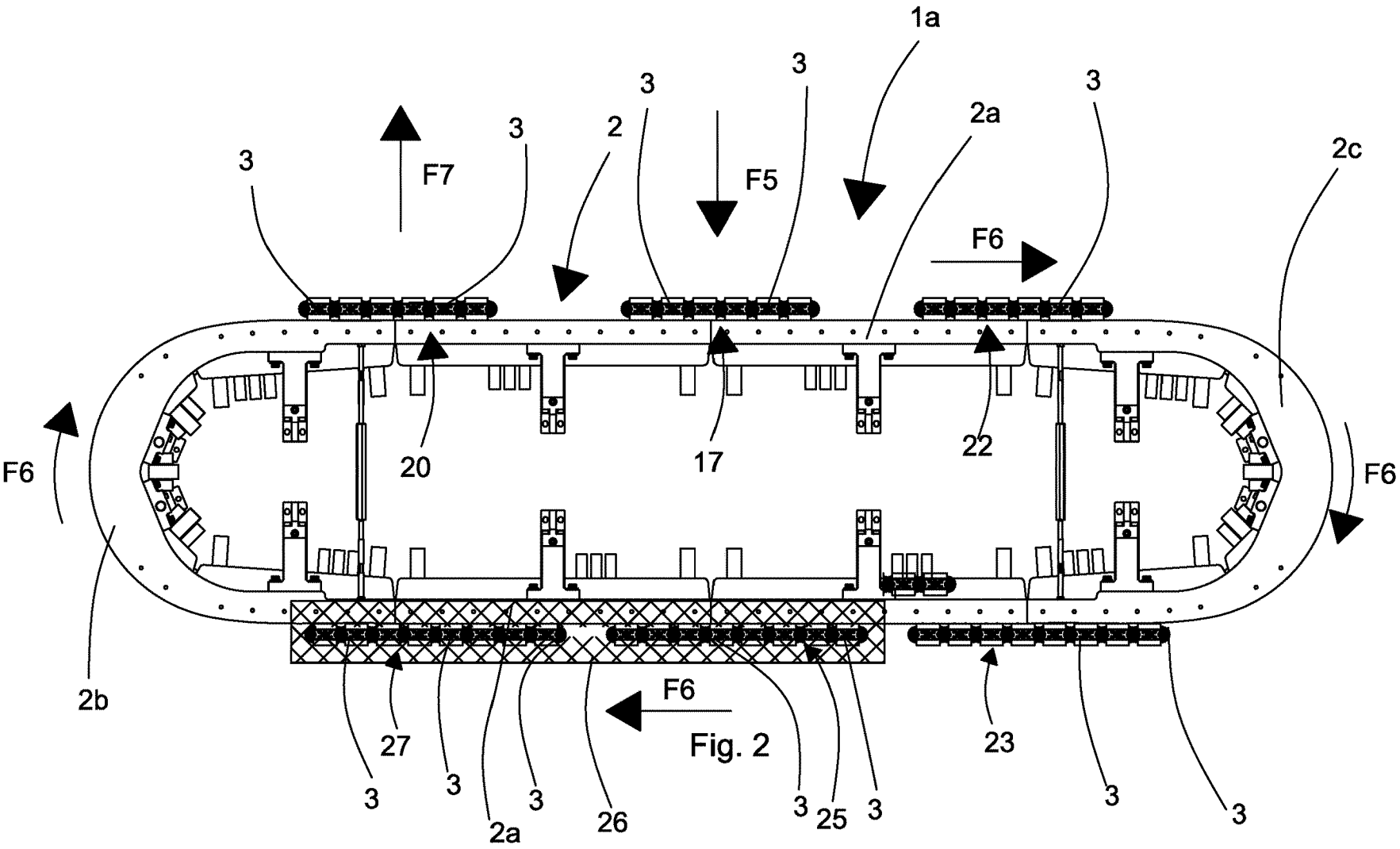
FIG. 2 is a schematic plan view of a second embodiment of a processing plant for processing capsules for beverages according to the invention, with magnetic conveying of the capsules along the plant.

In FIG. 2, a second embodiment of a plant according to the invention is illustrated that is indicated by reference number 1*a*. The parts of the plant 1*a* corresponding to parts of the plant 1 illustrated in FIG. 1 are indicated by the same reference numbers.

The plant 1*a*, similarly to the plant 1, comprises a magnetic conveying system, which operates according to the principle of the linear electric motor and comprises a rail 2, closed in a loop, along which conveying elements 3 are slidable, each of which is able to convey at least one respective capsule 9. The rail 2 comprises two rectilinear portions 2*a* that are parallel to one another, connected by two curvilinear portions 2*b* and 2*c*.

The rail 2 and the conveying elements 3 are identical to the rail and to the conveying elements disclosed with reference to the plant 1 illustrated in FIG. 1 and will accordingly not be disclosed further.

The plant 1*a* according to the invention is provided, along the rail 2, with a plurality of processing stations:

an inlet station 17 in which the capsules 9 coming from a direction F5, for example substantially perpendicular to the rail 2, are inserted, by an insertion device, which is not illustrated, into respective conveying elements 3 waiting in the first station 17;

a dosing station 22, in which a dosed quantity of a product for preparing a beverage is introduced into each capsule 9;

a sucking and cleaning station 23 of the edge 9*a* of the capsule 9 in which the edge 9*a* is cleaned of possible particles present thereupon which could hinder welding of the closing film on the edge 9*a*. Cleaning takes place by sucking said particles by using, for each capsule 9, a bell-shaped sucking element, which is shaped so as to adapt to the edge 9*a* of the respective capsule to prevent the product contained inside the capsule also being sucked;

an inerting station 25, which is inserted into an inerting tunnel 26, into which the air contained inside the capsule 3 is sucked and an inert gas is blown into the capsule, for example nitrogen, to create, inside the product for preparing a beverage an inert atmosphere that prevents, or, at least, minimizes the risk of fermentation or oxidation of the product; the tunnel 26 is provided with inlet and outlet devices that are used to insulate the inside of the tunnel from the outer environment, to prevent or at least minimize possible infiltrations of air inside the tunnel 26; the conveying elements 3 are advanced in the tunnel 26 continuously, at a constant speed;

a third shearing and welding station 27 in which closing discs of the capsules 9 are sheared from a sheet of aluminium, the closing discs of the capsules 9 being welded on the flange 9*a* of each capsule 9 to close the capsule 9 hermetically; in the third shearing and welding station 27 a seal ring can also be applied at a connecting zone between the flange 9*a* and the side wall of the capsule; also the shearing and welding station 27 is arranged in the inerting tunnel 26 to maintain the capsules in an inert nitrogen atmosphere and prevent the air being able to enter the capsules during the shearing and welding operations;

an outlet station 20 in which the capsules 9 are removed from the respective conveying elements 3 by a removing device and directed to a storage zone, which is not shown.

A weighing station (which is not shown) can be integrated into the outlet station 20; in this case the outlet station comprises a gripping device, which comprises, in turn, a first gripping element that removes the capsules 9 from the conveying elements 3 and deposits the capsules 9 on weighing devices, and a second gripping element that removes the capsules 9 from the weighing devices and deposits the capsules 9 on an evacuating conveyor belt for evacuating the capsules 9.

Before the outlet station 20, a checking and rejection zone 63 can be provided, in which the capsules 9 are checked to ascertain that they do not have defects and possibly defective capsules 9 are extracted before reaching the outlet station 20.

In the shearing and welding stations 18, 19, of the plant 1, and in the shearing and welding station of the plant 1*a*, the closing discs or filters are sheared with a so-called "quincunx" system, the object of which is to minimize the quantity of waste material, i.e. trimmings, that remains after shearing.

Figure 11:
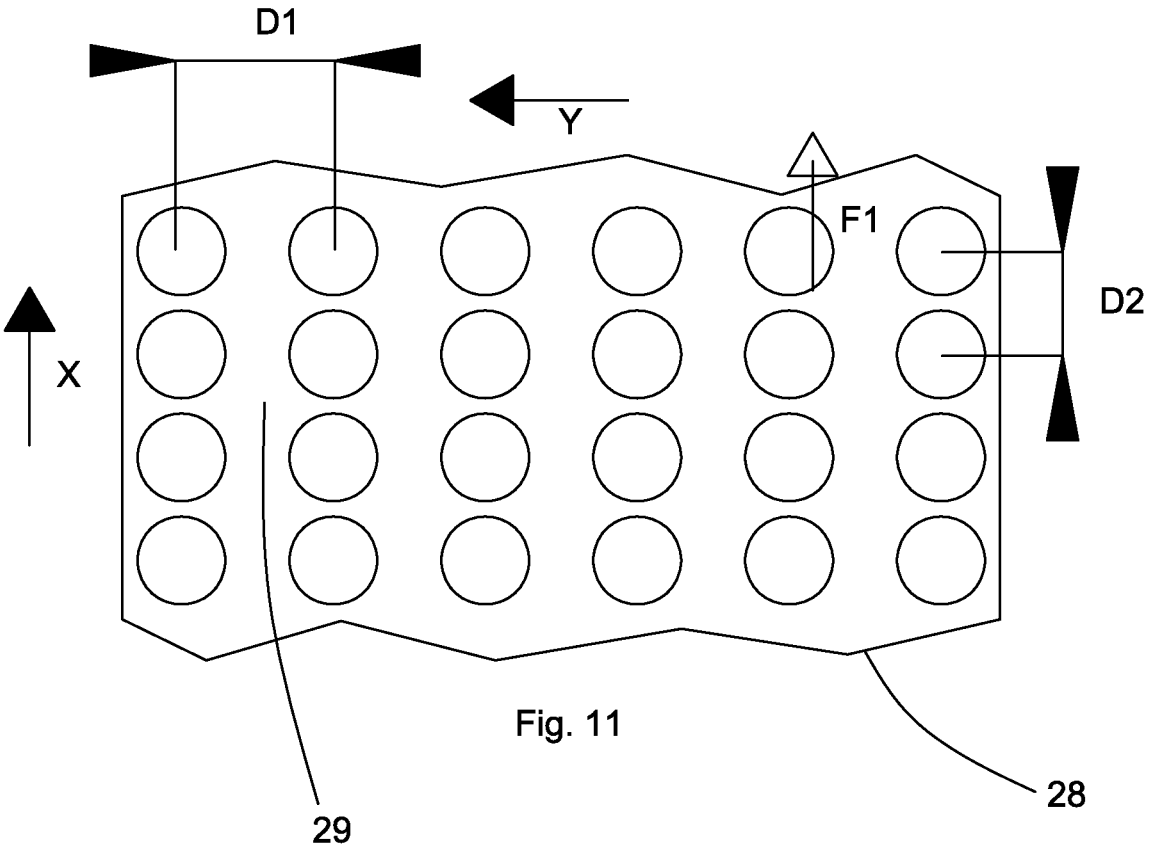
FIG. 11 is a diagram of shearing closing film or filters, from a sheet of closing material or material for filters, according to the prior art.
Figure 12:
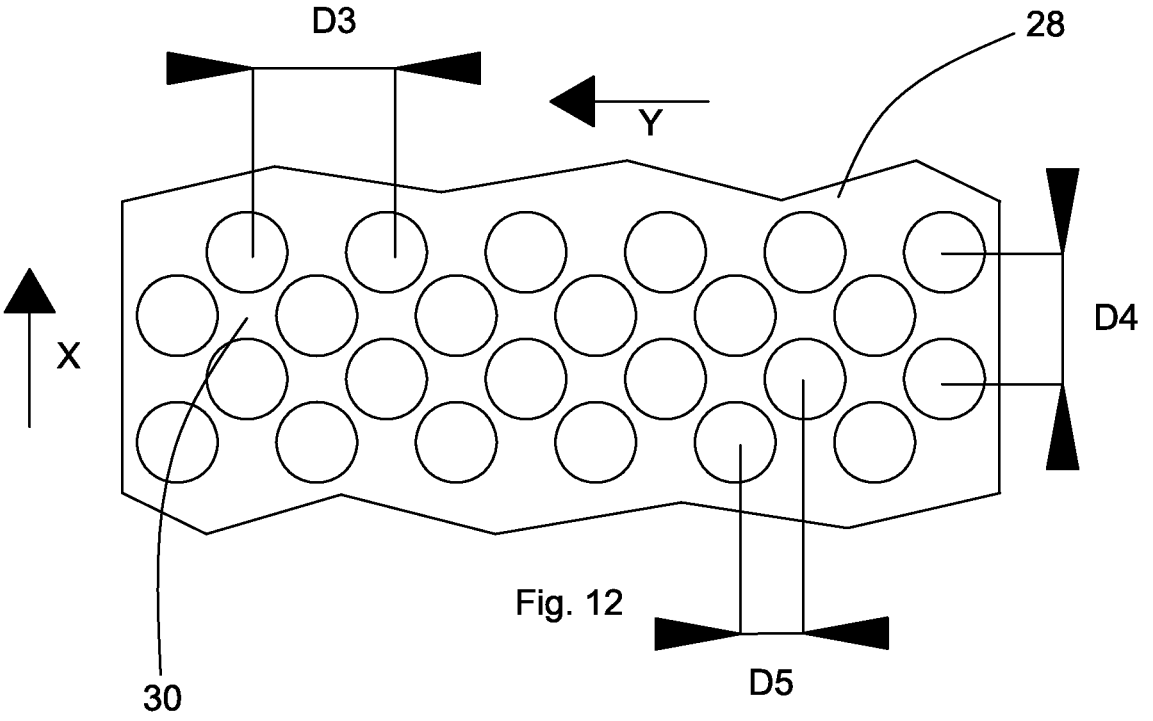
FIG. 12 is a diagram of shearing closing film or filters from a sheet of closing material or material for filters, according to the present invention.

In FIGS. 11 and 12, a shearing system according to the prior art, which is used in the processing plants for processing capsules for beverages according to the prior art, in which the capsules are conveyed by conveying elements known as "slat conveyors", and a "quincunx" shearing system according to the present invention are compared.

In the shearing system used in the plants according to the prior art, illustrated in FIG. 11, from a sheet of material, for example a sheet of aluminium or filter material, that advances in the shearing station in a direction X perpendicular to the advancement direction Y of the capsules, parallel rows of disc-shaped elements are sheared, each row comprising a number of disc-shaped elements equal to the number of the capsules arranged in a row of capsule seats on the respective slat conveyor.

With this shearing technique, there is a great quantity of waste material, because the distance D1 between one shearing zone and the adjacent zones in one row is fixed and depends on the distance of the capsules in a row on the respective slat conveyor, and also the distance D2 between the rows of shearing zones is also fixed and depends on the distance between the rows of capsules on the respective slat conveyor.

In FIG. 12, the shearing system used in the plants 1, 1*a* according to the invention is illustrated, in which the shearing zones on the sheet are arranged in rows that are staggered in relation to one another, so that it is possible to reduce considerably the distance between one row and the adjacent rows, inasmuch as the shearing zones of a row can be inserted at least partially into the spaces between the shearing zones of the adjacent rows, so as to reduce significantly the distance D4 between the rows, also the distance D3 between the shearing zones of the same row can be reduced, inasmuch as it depends on the minimum gap between two conveying elements 3, which is obtained when two adjacent conveying elements are in contact with one another, this gap being able to be made noticeably less than the gap between two capsule seats on the slat conveyors of the plants according to the prior art.

Figure 10:
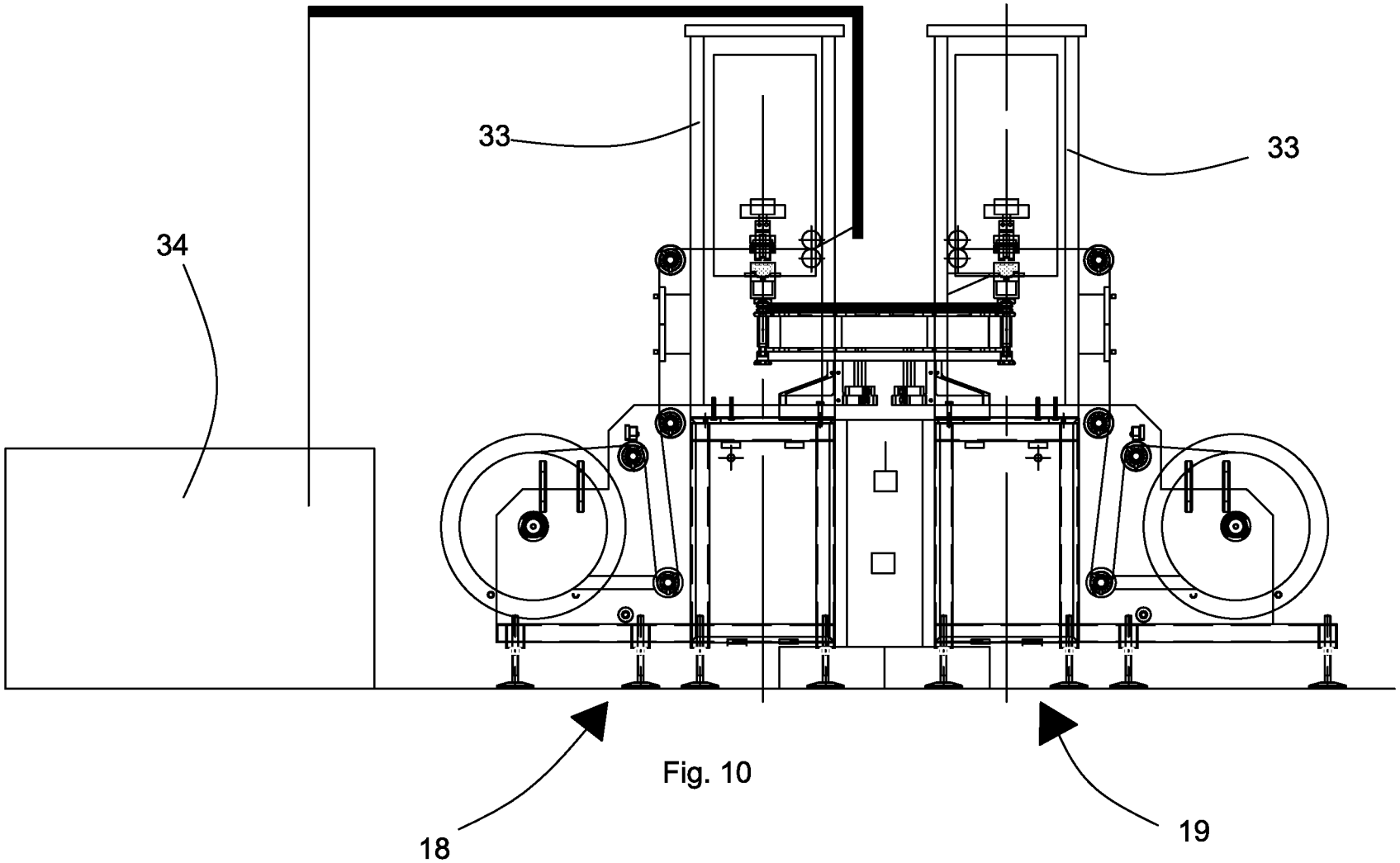
FIG. 10 is a front view of a plant according to the invention provided with modular processing stations.

Reducing the distances between the shearing zones in a single shearing row and the distance between adjacent shearing rows makes it possible to minimize the quantity of waste material that remains after shearing, as can be easily seen by comparing between them the zones 29 of the sheet 28 which remain whole after shearing, in the case of shearing according to the prior art illustrated in FIG. 10, and the zones 30 which remain whole after shearing, in the case of "quincunx" shearing according to the present invention.

"Quincunx" shearing according to the present invention, illustrated in FIG. 11, is obtained by moving forwards and backwards, in the respective shearing station 18, 19, 27, the conveying elements 3 in a direction parallel to the respective advancement direction F2, F6, so that they move between a first position P1 and a second position P2 (FIG. 1) separated by a distance D5 (FIG. 11) equal to the shifting in direction Y between a row of shearing positions and an adjacent row on the sheet 28. Together with the conveying elements, also the shearing and welding devices move by the aforesaid distance D5, in a coordinated manner with the conveying elements 3.

Alternatively, it is possible to perform "quincunx" shearing by maintaining the conveying elements 3 and the shearing devices stationary in the respective shearing station 18, 19, 27 and moving instead the sheet 28 in a direction parallel to the respective advancement direction F2, F6 of the conveying elements 3.

Figure 3:
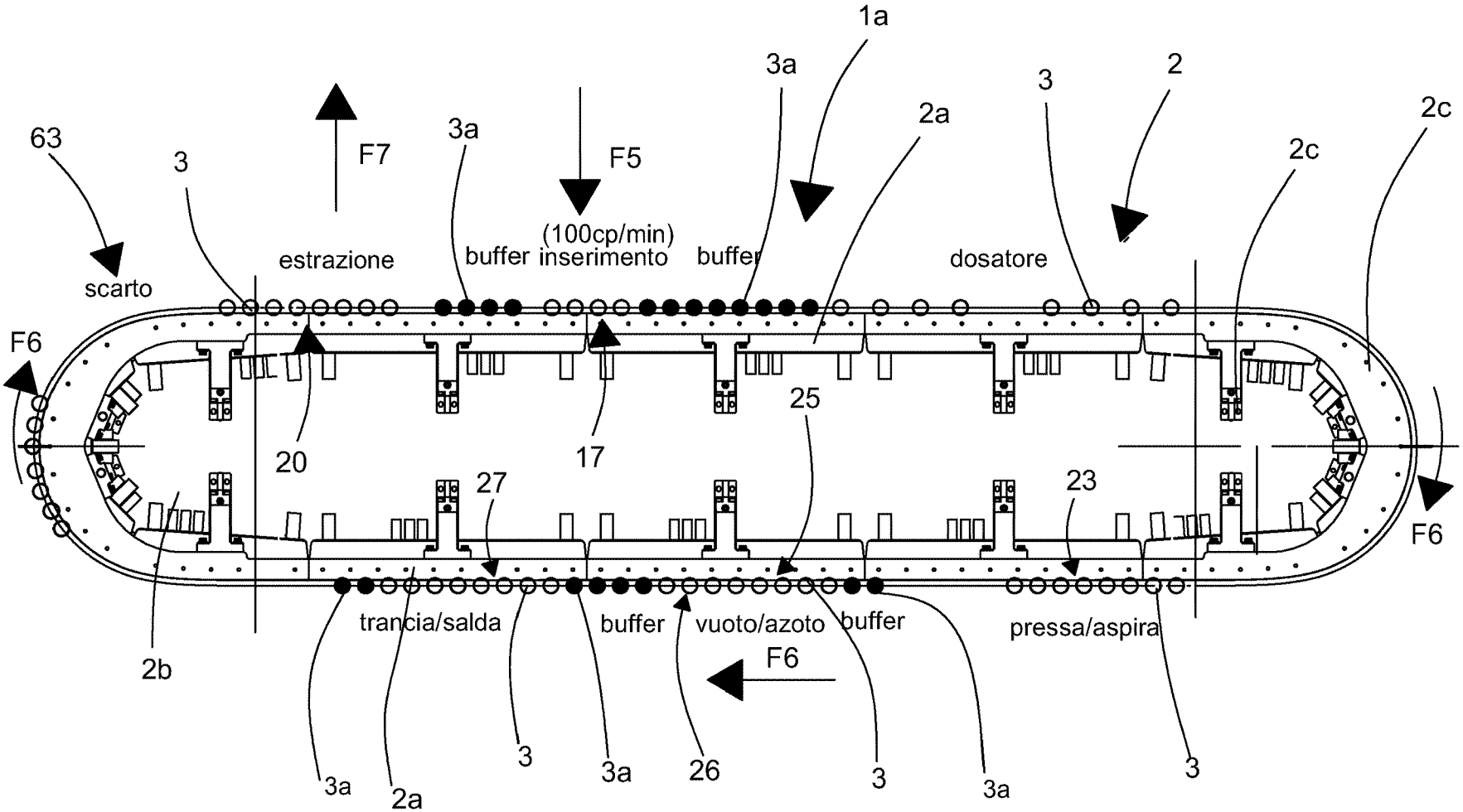
FIG. 3 is a schematic layout of the plant of FIG. 2, which illustrates the movement of the capsules along the plant.

In FIG. 3, a layout of the second plant version 1*a* is illustrated, highlighting the position of the conveying elements 3 with the respective capsules 9 along the plant.

The possibility of moving the conveying elements independently of one another makes it possible to form accumulating zones 3*a* along the rail 2, which are also called buffers, in which to group a plurality of conveying elements 3 outside the capsule processing stations. These accumulating zones 3*a* enable a constant flow of capsules to be obtained along the plant even if the processing times in the different stations of the plant are different from one another. It is further possible to create accumulating zones 3*a* at the inlet and outlet of the inerting tunnel 26 and between the inerting station 25 and the shearing/welding station 27 inside the inerting tunnel to achieve a longitudinal seal, at the inlet and outlet of the inerting tunnel 26 and in the space between the inerting station 25 and the shearing/welding station 27 inside the inerting tunnel 26, as will be explained better below with reference to FIGS. 21 and 22.

By way of example, a table is shown below showing: the number of conveying elements simultaneously present in each station, the number of capsules per minute that each processing station can treat, the advancement times of the conveying elements, the capsule 9 processing stations, the times of entry and exiting of the capsules into and from the aforesaid stations, the dwell times in the single stations, i.e. the time necessary for conducting on the capsules 9 the processing for which every single station is set up. The table relates to the second plant embodiment 1*a*, illustrated in FIG. 2. Similar tables can be drawn up for the other plant embodiments illustrated in FIGS. 1 and 4.

| | Conveying element no. | RPM | T. adv. | T. down | T. work | T. up | T. tot |
|---|---|---|---|---|---|---|---|
| Inlet station | 4 | 100 | 0.3 | | 0.3 | | 0.6 |
| Dosing station | 8 | 50 | 0.3 | 0.2 | 0.5 | 0.2 | 1.2 |
| Sucking and cleaning action | 8 | 50 | 0.3 | 0.2 | 0.5 | 0.2 | 1.2 |
| Inerting station | 8 | 50 | 0.3 | 0.1 | 0.7 | 0.1 | 1.2 |
| Shearing and welding station | 8 | 50 | 0.3 | 0.2 | 0.5 | 0.2 | 1.2 |
| Outlet station | 8 | 50 | 0.3 | | 0.9 | | 1.2 |

In the first column, the processing stations are indicated, in the second column the number of conveying elements that are simultaneously treated in each station, in the third column the number of capsules that are treated in a minute in each station, in the fourth column the movement time of the conveying elements 3 between one station and the next, in the fifth column the time of insertion of the conveying elements 3 into each station, in the sixth column the processing time of the capsules in each station, in the seventh column the time of exit of the conveying elements 3 from each station, in the last column the sum of the times from columns 3 to 7.

Figure 4:
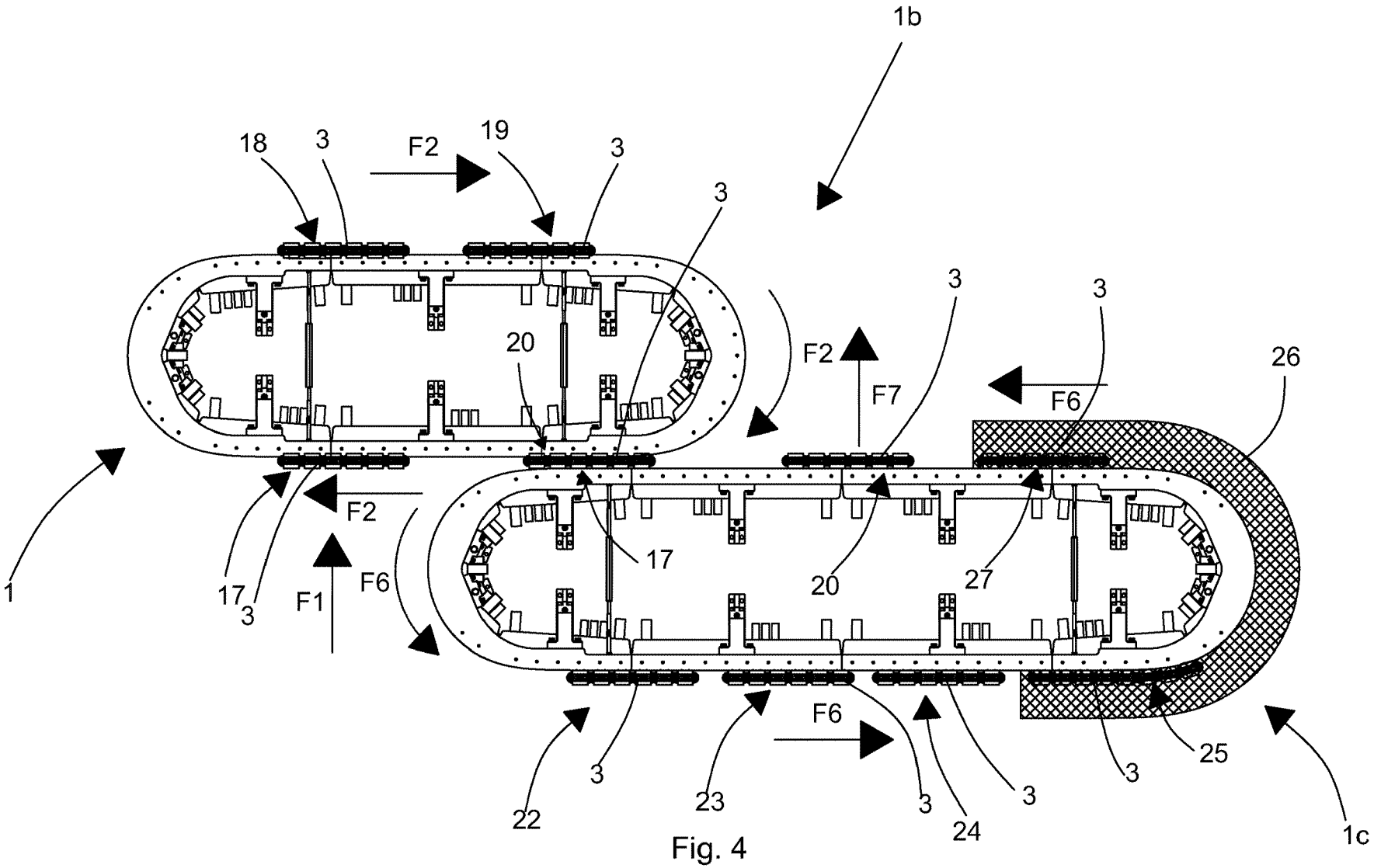
FIG. 4 is a schematic plan view of a third embodiment of a plant according to the invention, obtained from the union of the first plant embodiment illustrated in FIG. 1 and of the second plant embodiment illustrated in FIG. 2.
Figure 6:
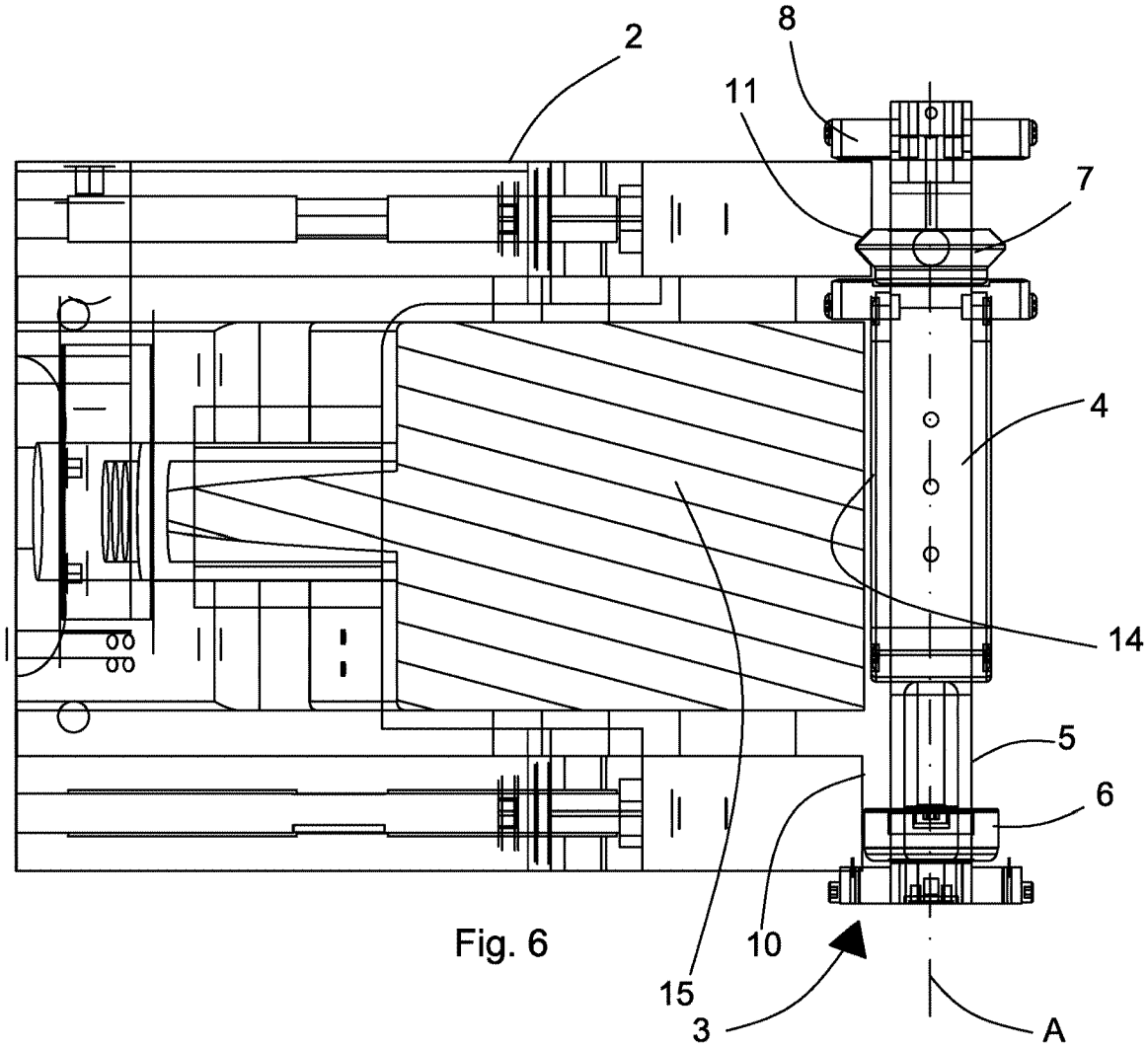
FIG. 6 is a side view of the conveying element of FIG. 5, associated with a rail of the magnetic conveying system, along which the conveying element moves.

Obviously, accumulating zones 3*a* of the conveying elements 3 with the respective capsules 9 can also be created in the first plant embodiment 1 according to the invention, illustrated in FIG. 1 and in the third plant embodiment 1*b* according to the invention, illustrated in FIG. 4.

In FIG. 4, a third embodiment of a plant according to the invention indicated by reference number 1*b* is illustrated.

The plant 1*b* consists of two parts, a first part the same as a plant 1 according to the first embodiment illustrated in FIG. 1 and a second part that comprises a plant 1*c* having a structure that is similar to that of the second plant embodiment 1*a* illustrated in FIG. 2.

The two plants are arranged in such a manner that the outlet station 20 of the first part 1 of the plant 1*b* faces the inlet station 17 of the second parte 1*c* of the plant 1*b*, at a distance that is such as to enable the conveying elements 3 that reach the outlet station 20 of the first part 1 to be taken up by the second part 1*c*, i.e. to be able to move automatically from the outlet station 20 of the first part 1 to the inlet station 17 of the second parte 1*c* to then be able to continue to move along the second part 1*a*, the transfer of the conveying elements 3 from the first plant part 1 to the second plant part 1*c* being able to occur without it being necessary to vary the movement speed of the conveying elements 3.

The second plant part 1*c* differs from the plant 1*a* illustrated in FIG. 2, by the fact that it comprises a weighing station 24 separated from the outlet station 20 and arranged downstream of the sucking and cleaning station of the edge 9*a* of the capsules 9 and before the inlet of the inerting tunnel 26.

The three plant embodiments illustrated in FIGS. 1 to 4 make evident the configuration flexibility of a plant according to the invention that can be adapted rapidly and simply to production needs and can be extended at will over time.

Figure 8:
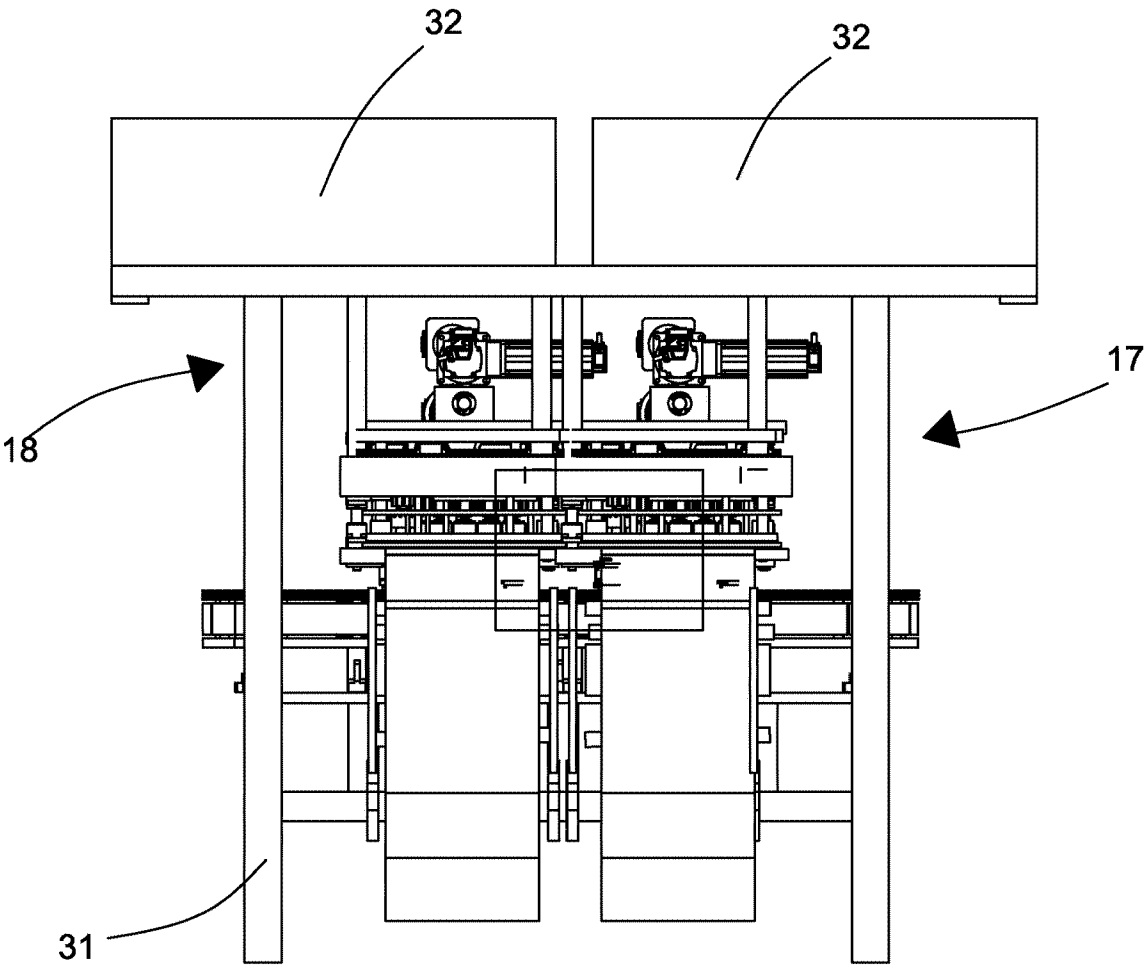
FIG. 8 is a raised side view of a plant for processing capsules for beverages according to the invention, highlighting two capsule processing stations for beverages.
Figure 9:
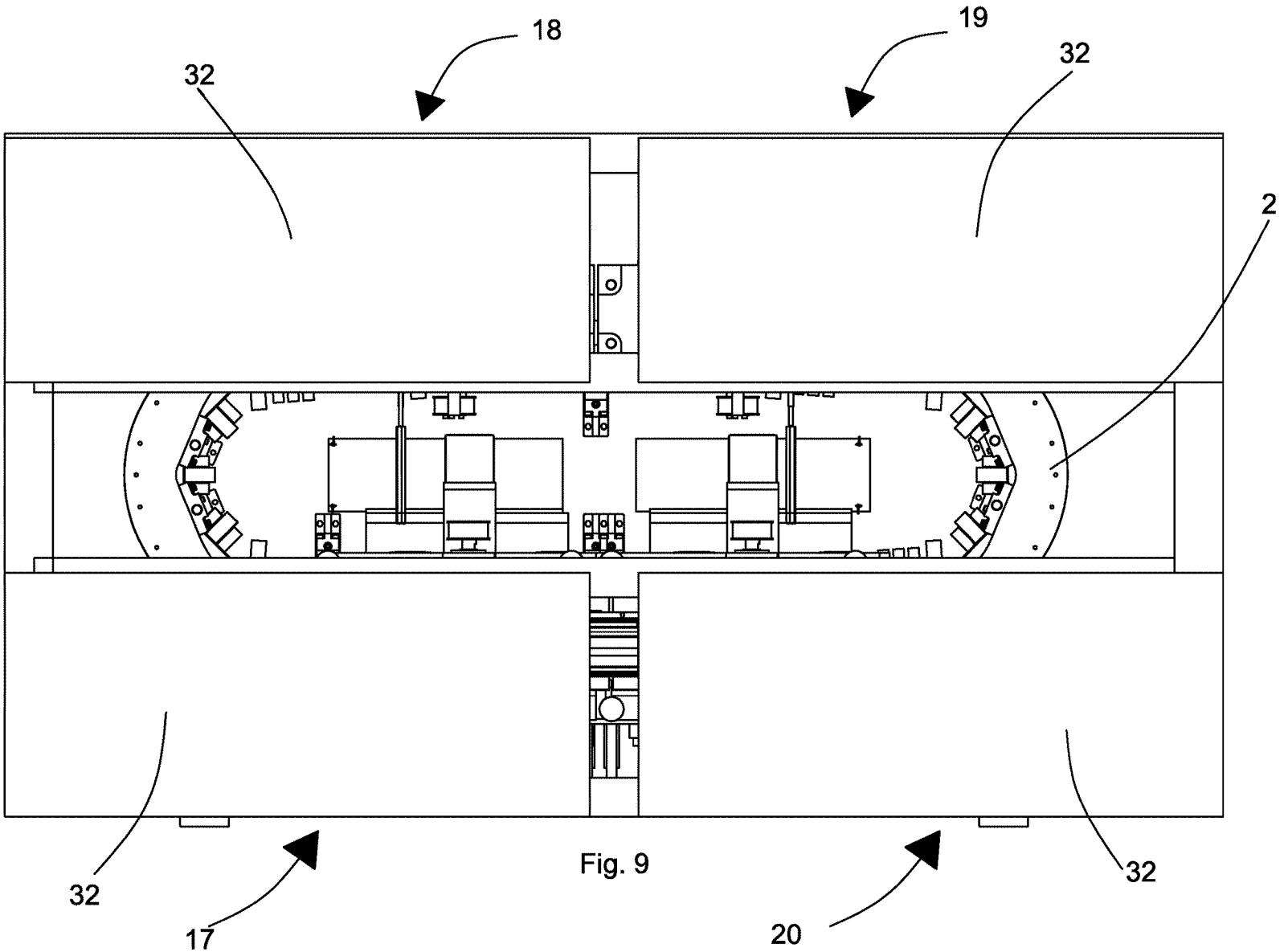
FIG. 9 is a top view of the plant of FIG. 8.

In FIGS. 8 and 9, a first type of processing station is illustrated that can be arranged along a plant according to the invention.

This first type of processing station is of fixed type, i.e. integrated into the plant, so that it has to be completely dismantled in the event of replacement.

In FIGS. 8 and 9, merely by way of example, a plant 1 according to the first embodiment is illustrated, with the inlet 17, shearing and welding 18 and 19 and outlet 20 stations.

The processing stations are fitted to a frame 31, on which also the rail 2 can be supported, each station is provided with an electric supply system and with a respective electronic control to drive the processing devices present in the station. The electric supply system and the electronic control are housed in respective housings 32 fixed to the frame 31.

In FIG. 10, a second type of processing station is illustrated.

In this type, the processing stations are of modular type and comprise a movable frame 33 to which all the processing devices are fitted of the respective station and the electrical connecting devices are set up to connect the station to an electrical supply network. Said processing stations of modular type can be inserted and detached rapidly and simply in a processing plant (1; 1*a*; 1*b*) according to the invention, enabling the configuration of the plant to be modified rapidly and simply, or processing stations that require repairs or maintenance to be replaced rapidly, minimizing plant downtime.

In FIG. 10, two shearing stations are illustrated, for example the first shearing station 18 and the second shearing station 19 of the first plant embodiment 1 according to the invention. In the representation of FIG. 10 the two shearing stations, rather than being arranged on the same side of the loop-shaped rail 2, are arranged on opposite sides of the loop-shaped rail 2.

The shearing stations can be provided with a container 34 in which the trimmings are collected that are created in the shearing operations.

Figure 13:
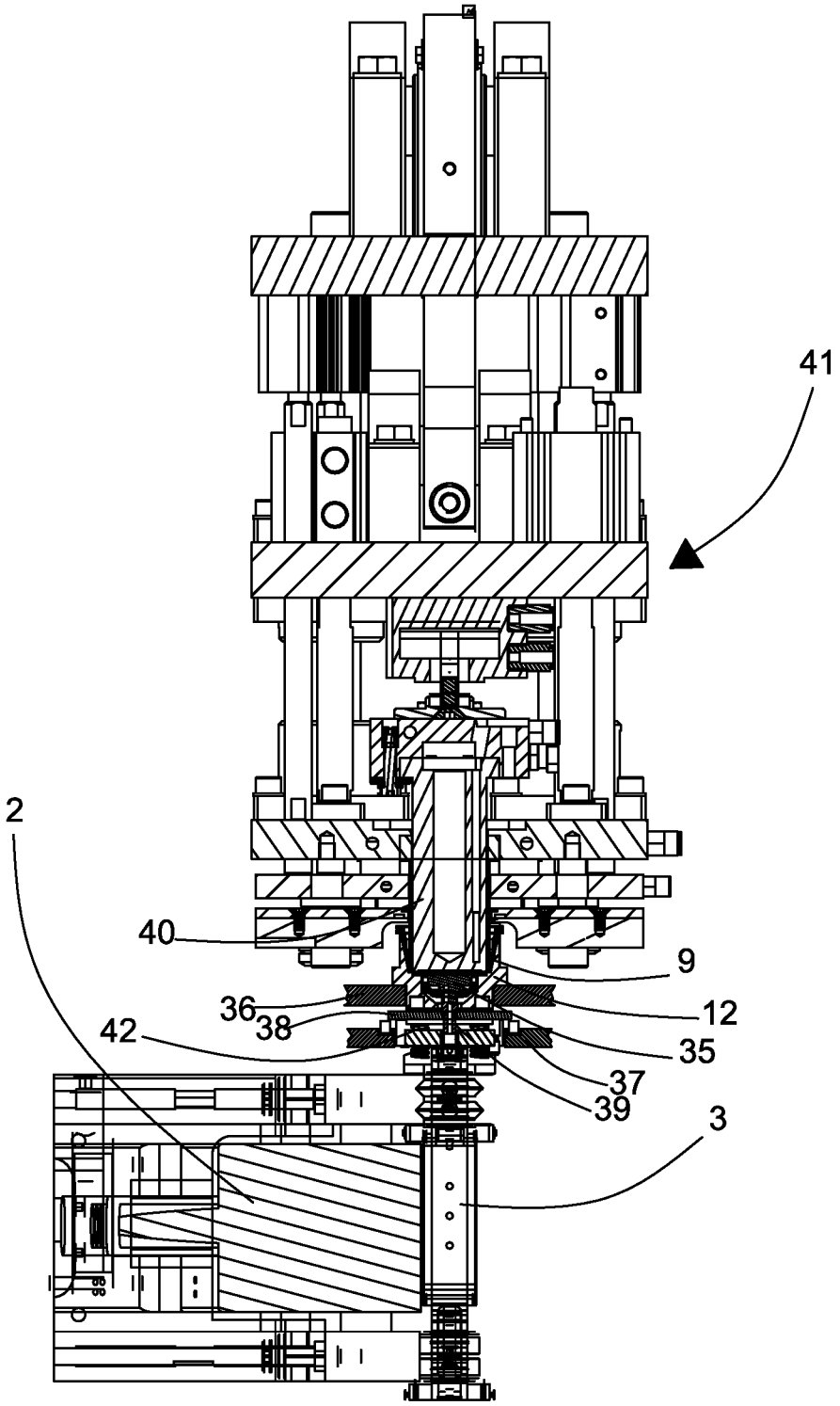
FIG. 13 is an elevation view of a conveying element with corresponding capsule, in a shearing and welding station of the first plant embodiment illustrated in FIG. 1, during the operation of welding a closing film, or a filter.

In FIG. 13, a welding system is illustrated of a closing film inside a capsule 9, of the type disclosed in Italian patent 102015000070588 in the name of the same applicant, which is provided with a movable plate 35 on which a closing film is welded.

In FIG. 13, the capsule 9 is shown inserted into a support element 12 fixed to a conveying element 3.

In the first shearing and welding station 18 of the closing film a resting element 36 is provided on which the support element 12 can be rested. The shearing and welding station is provided with a resting element for each support element 12 fitted to a respective conveying device 3.

In the first shearing and welding station 18 for each support element 12 an upwardly movable lifting element 37 is provided that is arranged for interacting with a pushing element 38, being part of the support element 12, said pushing element 38 being able to be pushed upwards against the force of a series of springs 42, to interact, by a pushing pin 39, with the movable plate 35 so as to provide a push upwards that offsets the pressure exerted by the welding head 40 of a welding device 41 with which the shearing and welding station is provided, in order to avoid possible damage to the capsule and to facilitate welding of the closing film on the plate. Upon completion of welding of the closing film on the movable plate 35, the lifting element 37 is moved downwards so that the pushing element 38 can return to the initial position through the effect of the return force of the springs 42.

Figure 14:
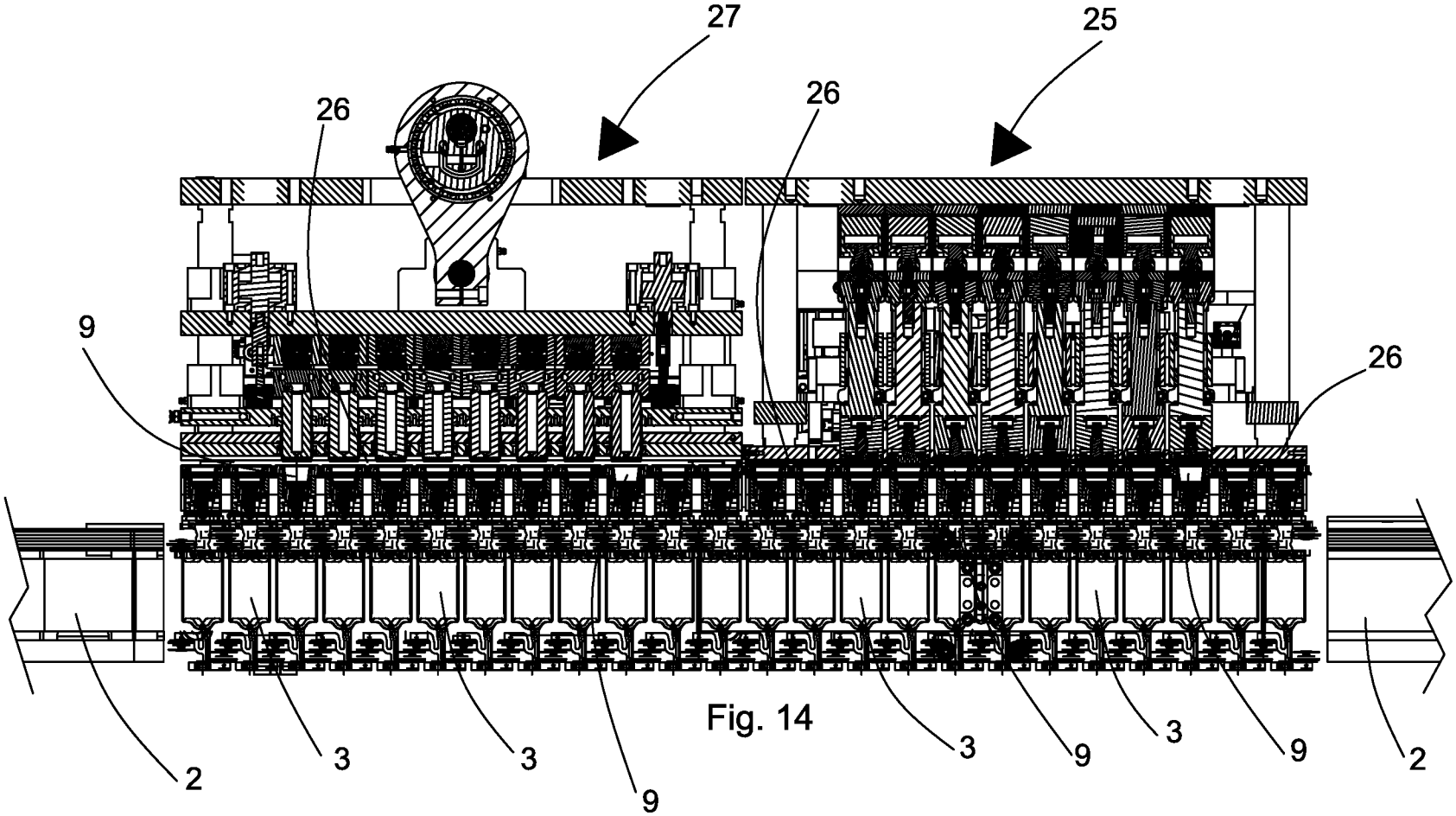
FIG. 14 is an elevation view of the inerting stations and shearing and welding stations of the closing film of the capsules, of the second plant embodiment illustrated in FIG. 2.

FIG. 14 shows a longitudinal section of the inerting station 25 and of the shearing/welding station 27 of the second plant embodiment 1*a*, illustrated in FIG. 2. In these stations, the capsules 9 transit inside an inerting tunnel 26 into which nitrogen is blown to maintain an inert atmosphere.

Inside the inerting tunnel 26, the capsules 9 transit in a compact configuration, substantially in contact with one another in such a manner that it is possible to prevent infiltrations of air coming from the outer environment into the inerting tunnel 26, as will be disclosed below.

Figure 16:
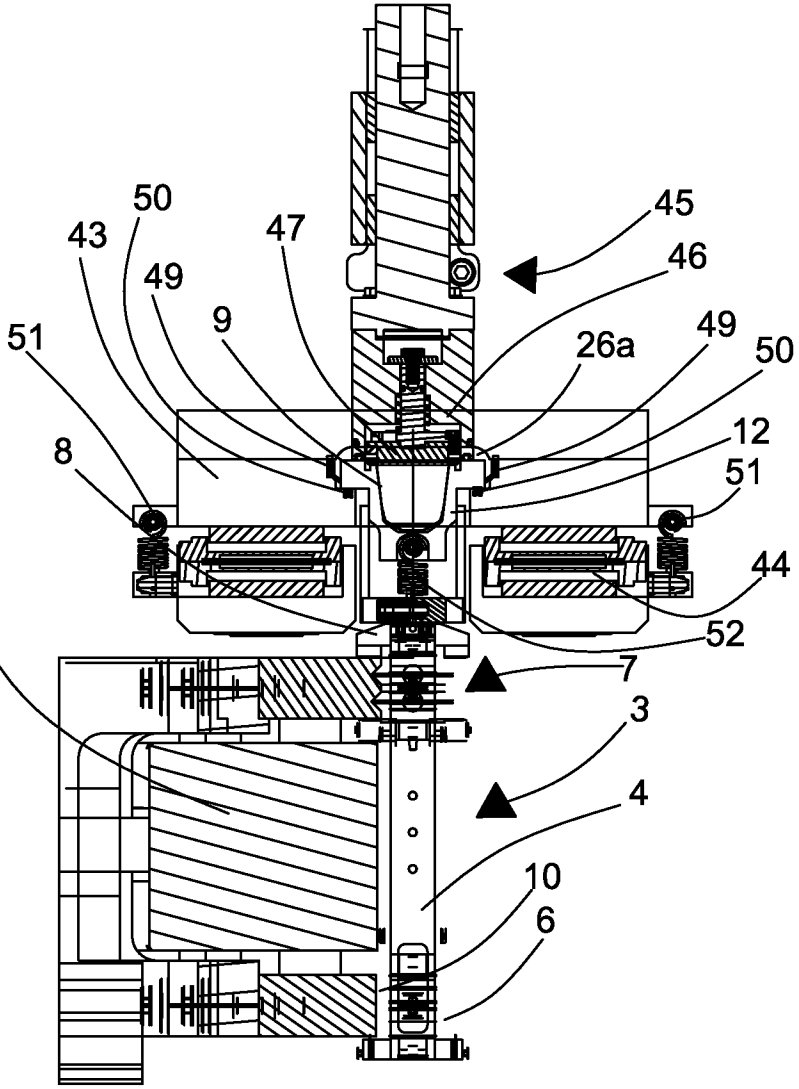
FIG. 15 and FIG. 16 show an enlarged detail of the inerting station of FIG. 14, in two different operating positions, which illustrate the suction of the air from a capsule and the replacement of the air with nitrogen.
Figure 15:
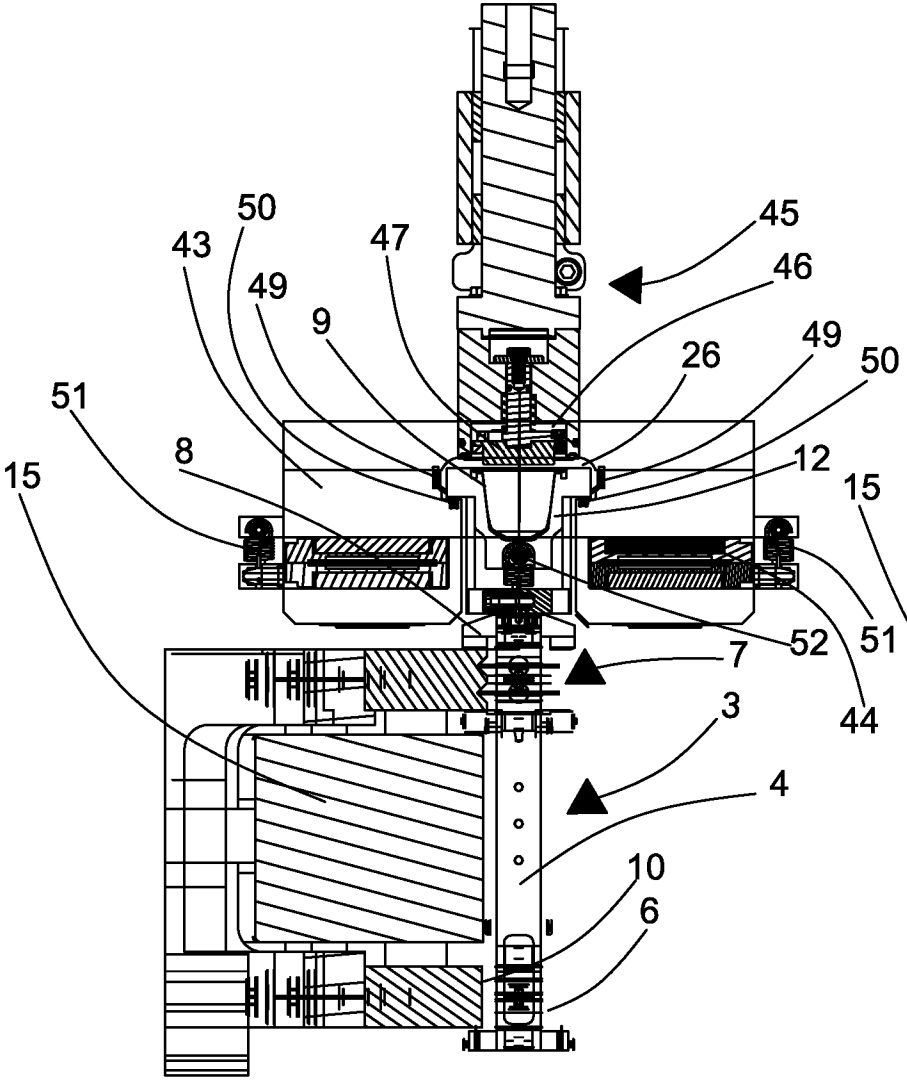

In FIGS. 15 and 16, suction of the air from a capsule and replacement thereof with nitrogen is illustrated, in the inerting station 25 of the second plant embodiment 1*a*, illustrated in FIG. 2 and in a version 1*c* thereof illustrated in FIG. 4.

The inerting station comprises a plurality of sucking and insufflation devices 45, each of which is intended to suck the air contained inside a capsule 9, into which a dose of product, for example coffee, has been delivered in the dosing station for preparing a beverage, and is intended to blow nitrogen inside the capsule 9. Replacing the air within the capsule 9 with nitrogen is used to prevent, after sealing of the capsule 9, possible product fermentation phenomena occurring that, in addition to making the quality of the product deteriorate, cause gas to develop, which could damage the integrity of the capsule 9.

Each suction and insufflation device comprises a plug 47 that is intended to be inserted into the mouth of the capsule 9 so as to close the capsule 9, to prevent, in the step of sucking of the air, the product contained inside the capsule 9 from being able to be sucked. With the term "mouth of the capsule" the opening surrounded by the flange 9*a* of the capsule 9 is intended, through which it is possible to access the inside of the capsule 9, before it is sealed with a closing film.

In order to enable the air to be sucked inside the capsule 9, the plug 47 is made of a porous or microperforated material, the pores or the microperforations of the material of the plug 47 being of dimensions that are such as not to permit the transit of particles of the product contained in the capsule 9.

The plug 47 is inserted into a chamber 46, in which a vacuum is initially created to suck the air from the inside of the capsule 9, and subsequently pressurized nitrogen is delivered to obtain an inert atmosphere inside the capsule.

The sucking and insufflation devices 45 are operationally associated with a lifting device 43, 44 that comprises a plate element 43, which extends over the entire length of the inerting station 25 and preferably consists of two superimposed plates that are connected together. The plate element 43 is connected by a plurality of springs 51 to a membrane lifting element 44 that can expand upwards, so as to lift the plate element 43 against the action of the springs 51.

A longitudinal channel 26*a* is made inside the plate element 43 that defines the inerting tunnel 26 in the inerting station 25.

The longitudinal channel 26*a* has a shape and dimensions that are such as to enable the support elements 12 of the capsules 9 fixed to the conveying elements 3 to transit inside the longitudinal channel 26*a*.

The longitudinal channel 26*a* is provided with a pair of first seals 49 that extend over the entire length of the longitudinal channel and are arranged on sides opposite the support elements 12, in such a manner as to create a lateral seal between the support elements 12 and the longitudinal channel 26*a*. The first seals 49 are lip seals.

The longitudinal channel 26*a* is further provided with a pair of second seals 50, which also extend over the entire length of the channel 26*a* and are intended to create a downward seal between the support elements 12 and the longitudinal channel 26*a*.

The first seals 49 and the second seals 50 are used to prevent the entry of air from the outside into the channel 26*a* during the operations of sucking the air from the capsules 9 and blowing nitrogen into the capsules 9.

In FIG. 15, a capsule 9 is illustrated that has been conveyed by a respective conveying element 3 to the inside of the longitudinal channel 26*a* and positioned below a respective sucking and insufflation device 45, before sucking of the air inside the capsule 9 starts. In this condition, the plate element 43 rests on the lifting element 44, which is in a non-operating condition, without the springs 51 being stressed. The plug 47 is not yet inserted inside the capsule 9. The seal between the support element 12 of the capsule 9 and the longitudinal channel 26*a* is guaranteed by the first seals 49.

In FIG. 16, the capsule 9 is illustrated during the operations of sucking the air and blowing nitrogen.

Before sucking the air starts, the lifting element 44 is activated that pushes upwards the plate element 43, that, by coming into contact with the support element 12 of the capsule 9 pushes the support element 12 upward, so that the plug 47 is inserted into the mouth of the capsule 9.

Sucking of the air inside the capsule 9 then starts, followed by blowing of nitrogen.

During these operations, the seal between the support element 12 of the capsule 9 and the longitudinal channel 26*a* is ensured both by the first seals 49, and by the second seals 50.

After the end of the sucking and insufflation operations, the lifting element 44 returns to the non-operating position and the plate element 43 is returned downwards by the springs 51. Simultaneously, also the support element 12 of the capsule 9 is returned downwards by a return spring 52.

In FIGS. 17, 18, 19 and 20, shearing of a disc 61 from a sheet 53 of closing material is illustrated, for example aluminium or a multilayered material with at least one layer of aluminium and sealing of the disc 61 on the flange 9*a* of each capsule 9 to seal the capsule 9 hermetically is illustrated. Shearing and welding of the closing film occur in the shearing and welding station 27, located downstream of the inerting station in the direction of motion of the capsules along the plant 1*a*, indicated by the arrows F6 in FIG. 2.

The shearing and welding station 27 comprises a plurality of shearing and welding devices 58, each of which comprises a shearing punch 55 and a welding punch 56 that is concentric inside the shearing punch 55. The shearing punch 55 and the welding punch 56 can move together or independently of one another.

The shearing and welding station 57 further comprises a lifting device 43, 44 that is completely identical to the lifting device disclosed with reference to the inerting station, to the description of which reference is made.

Lastly, in the shearing and welding station 27 an immobilizing plate 54 is provided the function of which is to immobilize the film 53 of closing material during the shearing and welding operations.

The immobilizing plate extends over the entire length of the shearing and welding station.

Figure 17:
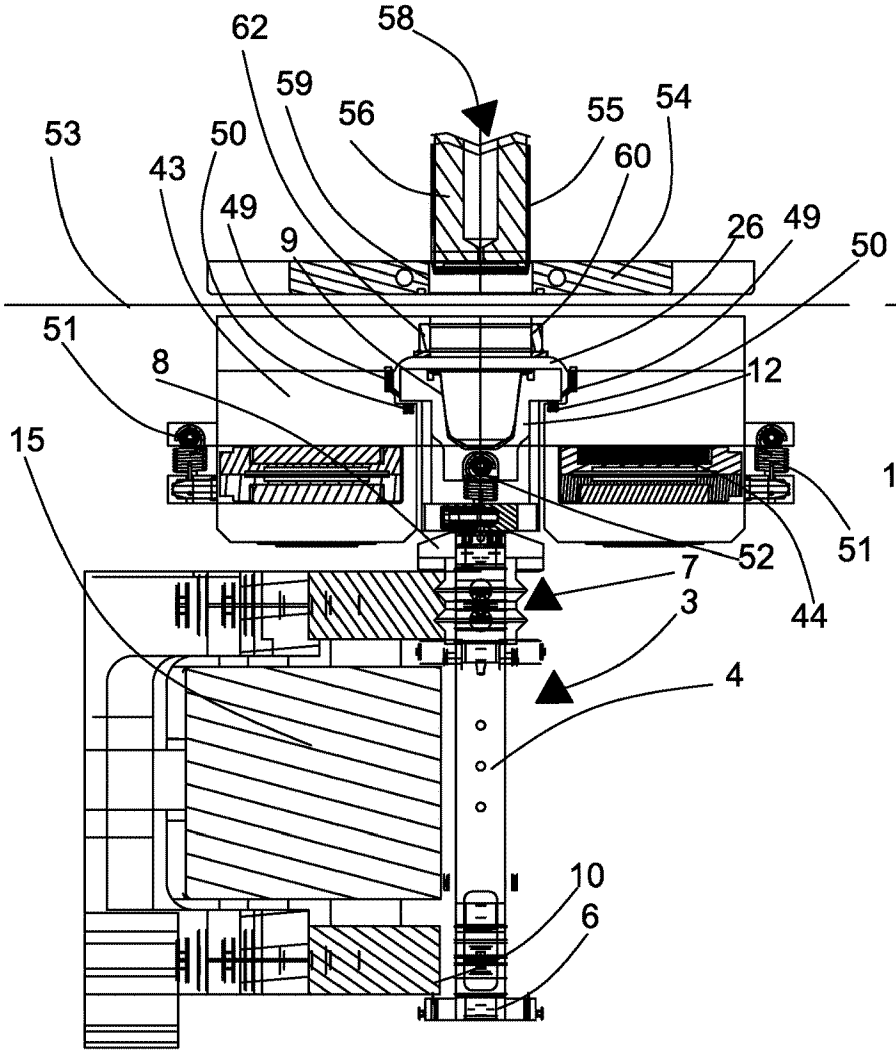

In FIG. 17, a capsule 9 is illustrated that has been conveyed by a respective conveying element 3 inside the longitudinal channel 26*a* and positioned below a respective shearing and welding device 58, before shearing of the film of closing material starts. In this condition, the plate element 43 rests on the lifting element 44, which is in a non-operating condition, without the springs 51 being stressed. The plug 47 is not yet inserted inside the capsule 9. The seal between the support element 12 of the capsule 9 and the longitudinal channel 26*a* is guaranteed by the first seals 49.

Figure 18:
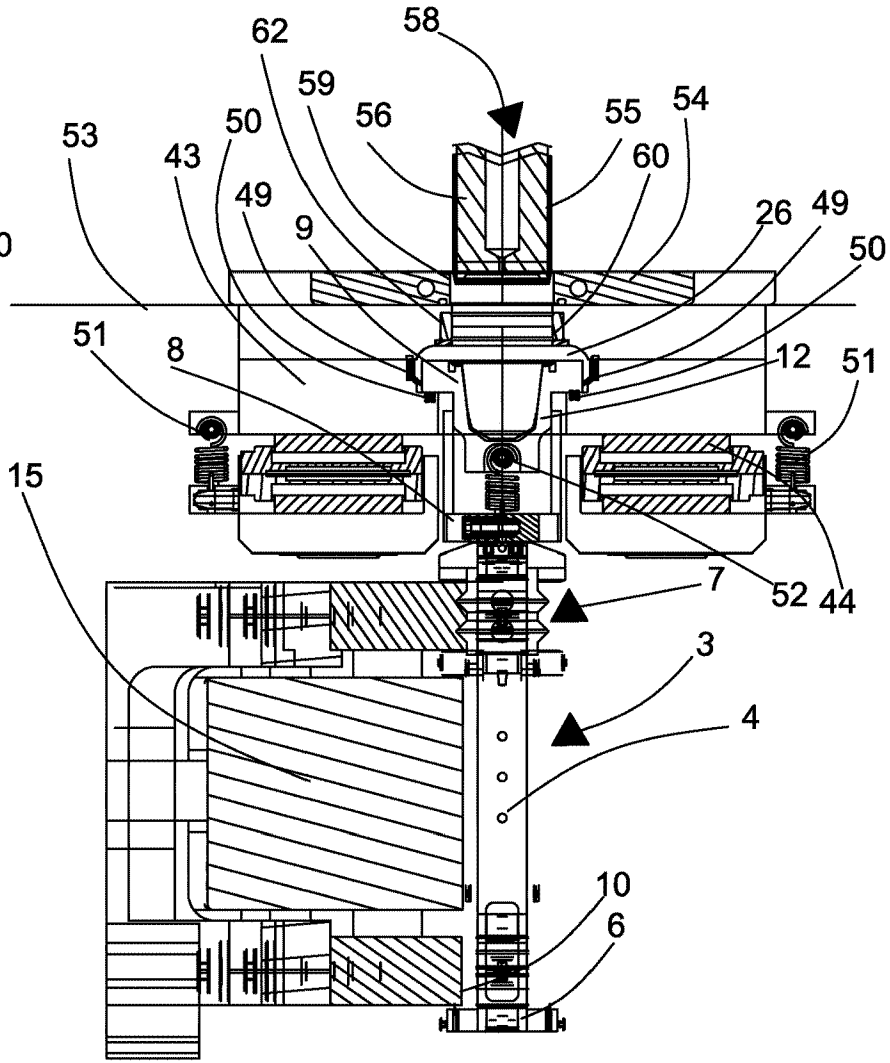
FIGS. 17, 18, 19 and 20 show an enlarged detail of the shearing and welding station of FIG. 14 in four different operating positions, which illustrate the shearing and welding of the closing film of the capsule, in a shearing and welding station of the second plant embodiment illustrated in FIG. 2.

After the capsule 9 has been positioned below the respective shearing and welding device 58, the lifting element 44 is activated that pushes upwards the plate element 43 that, by entering in contact with the immobilizing plate 54, immobilizes the film 53 of closing material against the immobilizing plate 54, as illustrated in FIG. 18.

Simultaneously, the plate element 43, by coming into contact with the support element 12 of the capsule 9, pushes the support element 12 upwards.

Figure 19:
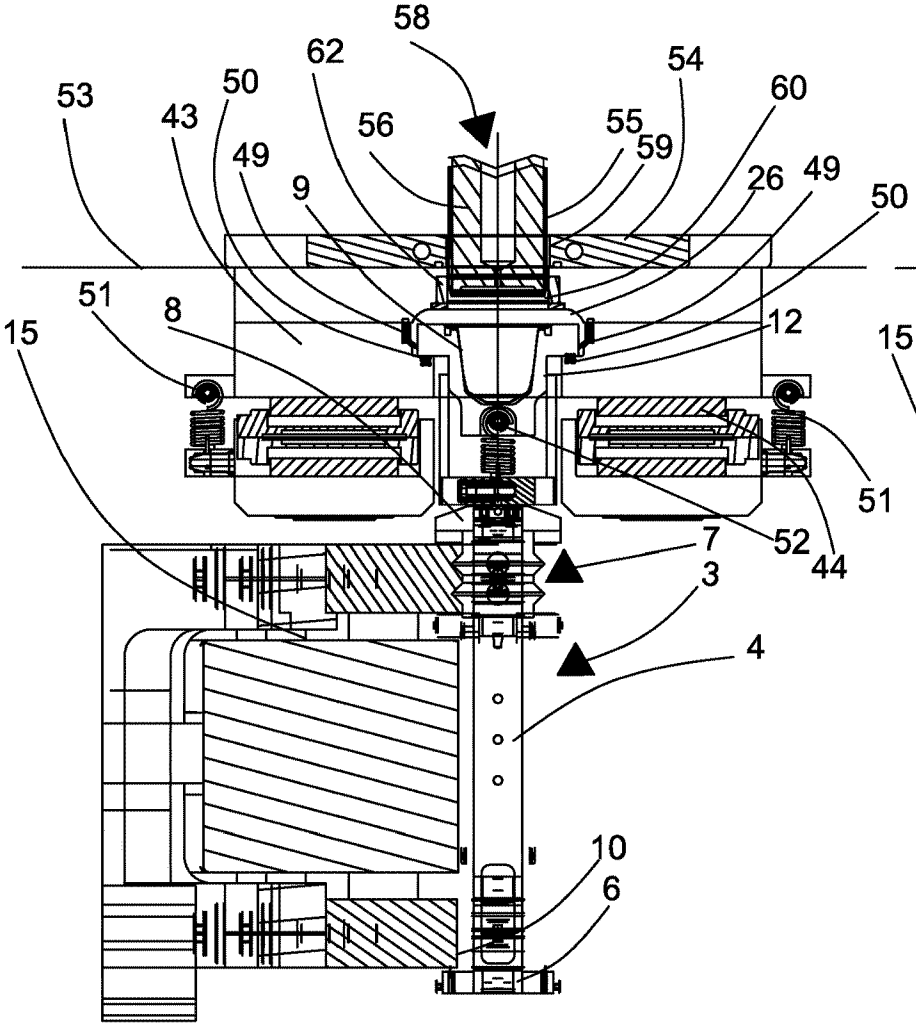

In FIG. 19, the operation of shearing the film 53 of closing material is illustrated, in which, whilst the film 53 remains immobilized between the immobilizing plate 54 and the plate element 43, the shearing punch 55 is lowered together with the welding punch 56, passing through a through opening 59 provided in the immobilizing plate 54, so as to interact with the film 53 and shear therefrom a disc 61 of material having a diameter that is substantially the same as the diameter of the flange 9*a* of the capsule 9.

After shearing the disc 61, the shearing punch 55 descends further, passing through a further opening 60 of the longitudinal channel 26*a* so as to convey the disc 61 to the flange 9*a* of the capsule 9.

In the further opening 60, an annular distributing element 62 is provided that is made of porous or microperforated material, through which a flow of nitrogen is delivered to the channel 26*a* to maintain therein positive nitrogen pressure that prevents the air from penetrating from the outside into the channel 26*a*.

Figure 20:
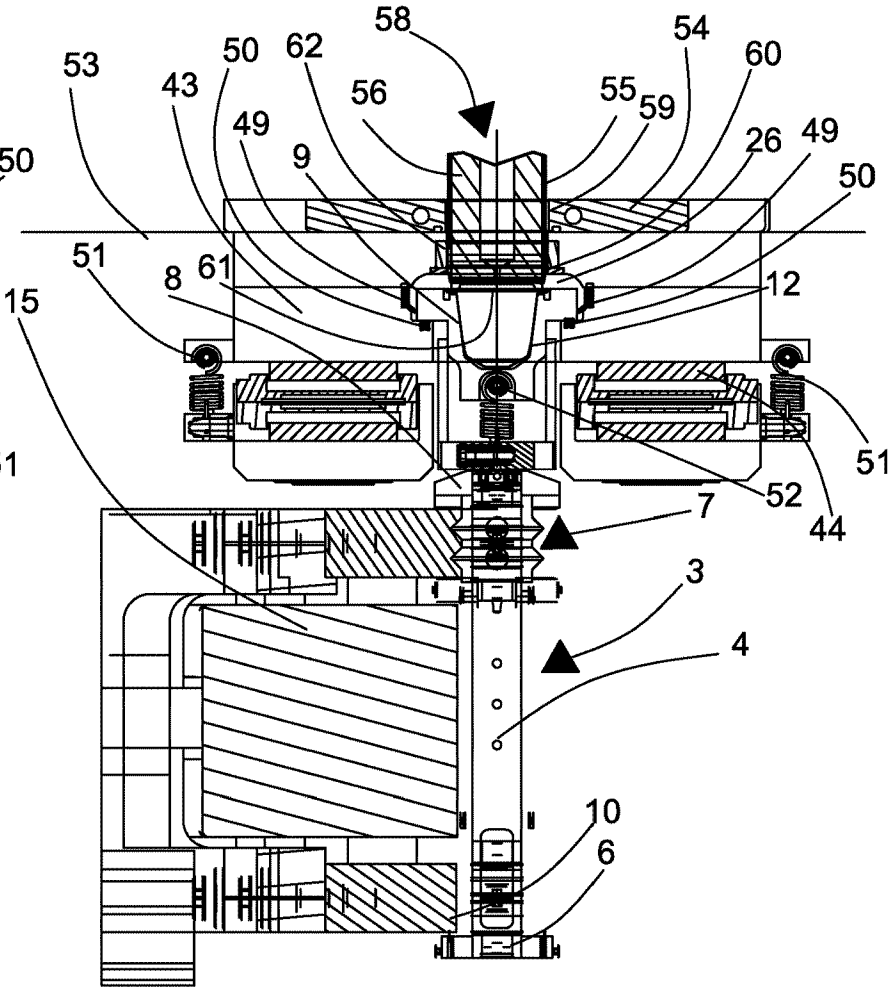

Last, as illustrated in FIG. 20, the welding punch 56 is lowered further, maintaining the shearing punch 55 stationary, so as to push the disc 61 against the surface of the flange 9*a* and weld the disc 61 on the flange 9*a*, for example by hot welding.

Figure 21:
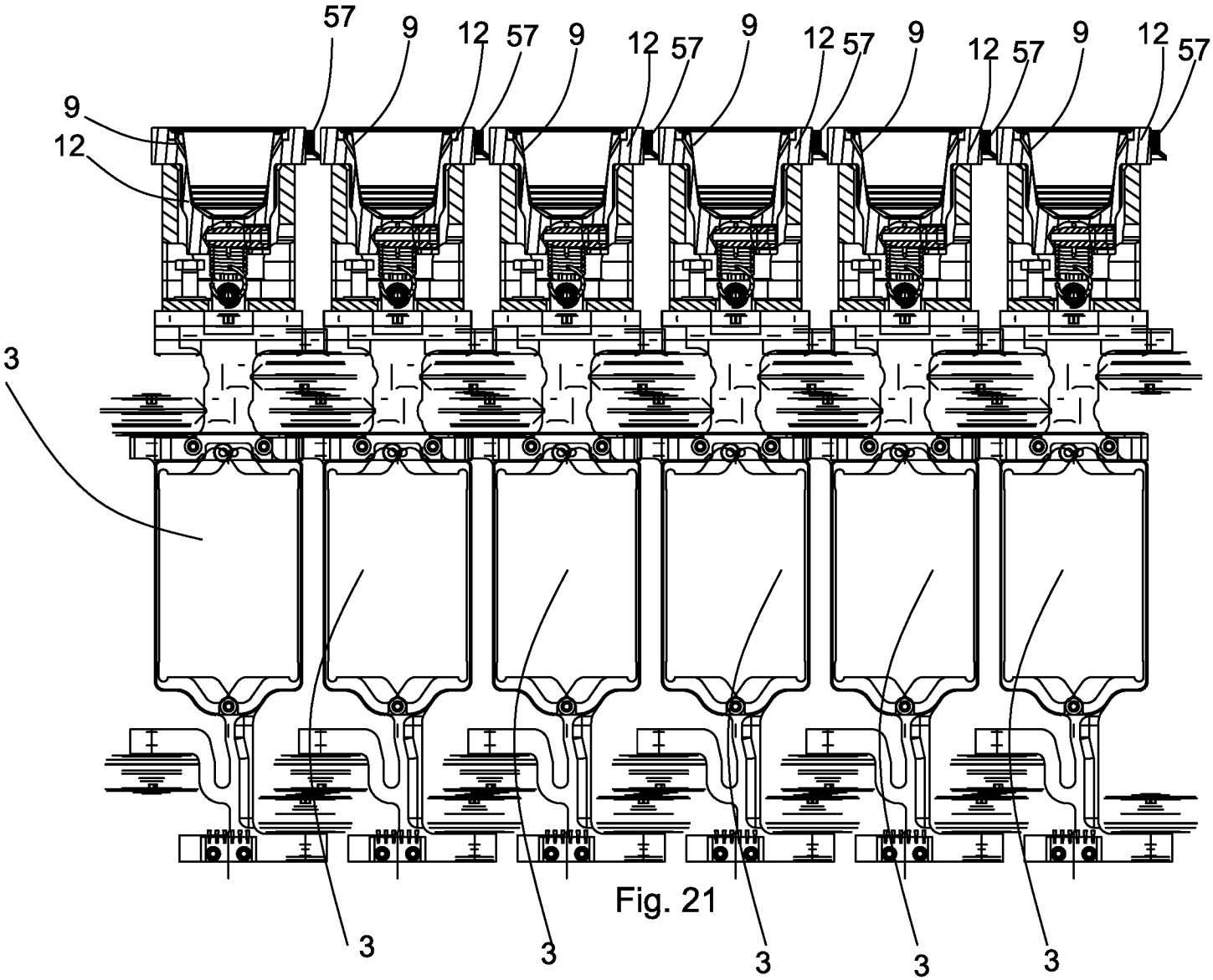
FIG. 21 illustrates a group of adjacent capsules with seal elements configured for minimizing nitrogen loss in the inerting stations and shearing/welding stations of the second plant embodiment illustrated in FIG. 2.
Figure 22:
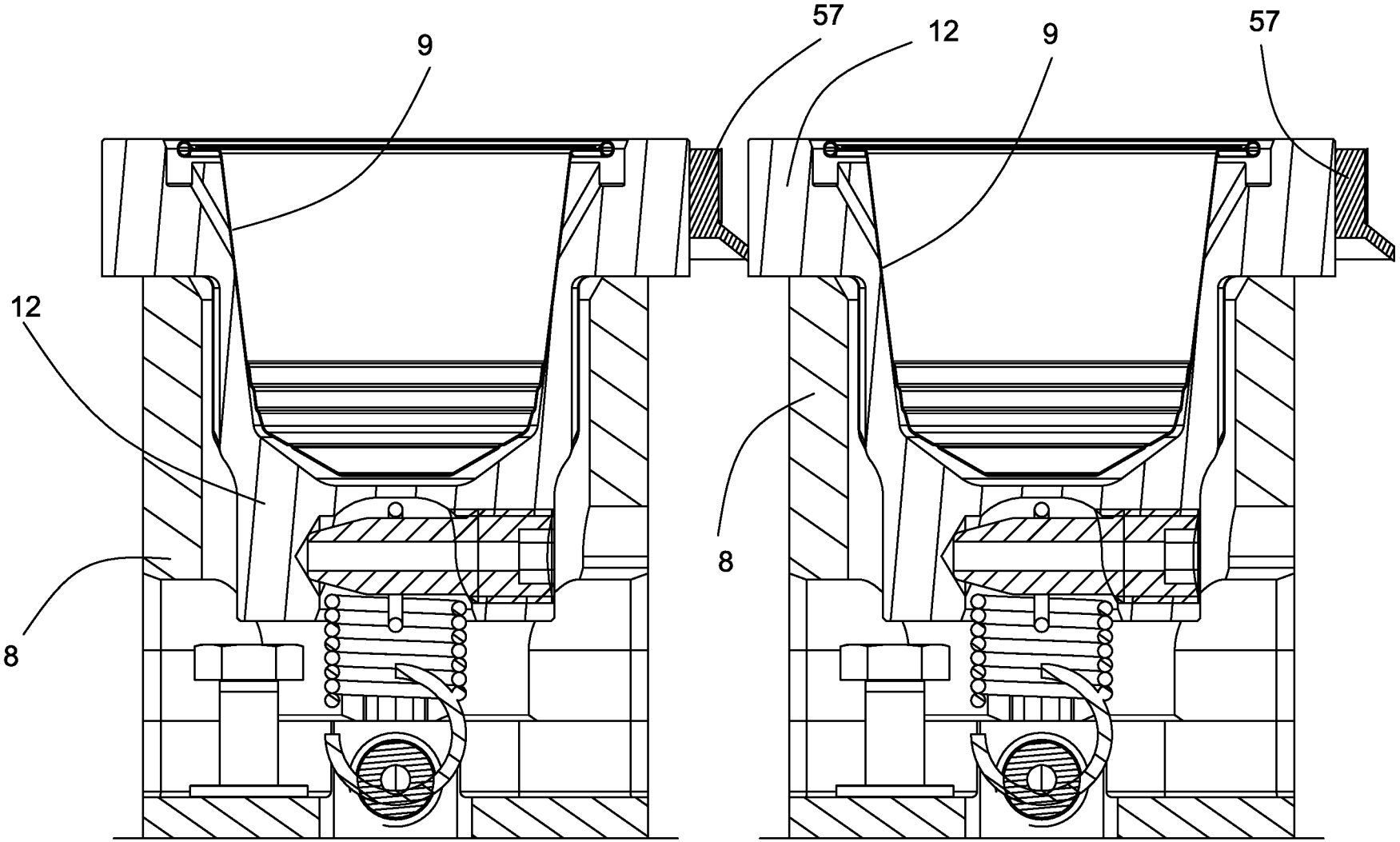
FIG. 22 is an enlarged detail of FIG. 21.

In FIG. 21, a group of conveying elements 3 is illustrated, each of which carries a respective capsule 9. The conveying elements 3 are arranged in a compact configuration, i.e. at the least possible distance from one another. This is for example the configuration used inside the inerting tunnel 26.

In order to achieve a seal in a longitudinal direction between the capsules 9, to prevent infiltration of air from the outside into the inerting tunnel 26, each support element 12 is provided with a seal 57, for example a lip seal.

When the capsules are in the compact configuration illustrated in FIG. 20, the seal 57 of each support element 12 is compressed against an adjacent support element 12 so that a longitudinal seal is achieved between the support elements 12 in the inerting tunnel 26. This enables a longitudinal seal to be achieved, not only in the inerting stations 2.

FIG. 21 is an enlarged detail of FIG. 20, in order to show better the seals 57 of the support elements 12.

The invention claimed is:

1. A plant for processing capsules for preparing beverages, comprising:

at least one rail, a plurality of conveying elements independently movable along the at least one rail, a support element received within each conveying element, the support element defining a cavity and having an upper annular rim, wherein the support element is configured to receive a capsule such that an annular flange of the capsule rests on the upper annular rim, an inlet station configured to introduce capsules into the cavities of the support elements, an outlet station configured to remove capsules from the support elements, a plurality of processing stations arranged along said at least one rail between said inlet station and said outlet station, wherein said plurality of processing stations comprises a dosing station configured to dispense a predetermined quantity of product into each capsule received in a support element, and a welding station configured to weld a closing disc onto each capsule to close the capsule, wherein each conveying element is configured to receive at least one capsule and is movable independently of all others of the conveying elements along said at least one rail, and wherein said at least one rail and said plurality of conveying elements define an electromagnetic conveying system, and wherein the support element with the received capsule is lifted from the conveying element when the support element is aligned with the welding station.

2. The plant according to claim 1, wherein said rail comprises a plurality of rectilinear rail portions and a plurality of curvilinear rail portions.

3. The plant according to claim 2, wherein said rail comprises curvilinear portions having different angular measures.

4. The plant according to claim 1, wherein said rail is loop-shaped.

5. The plant according to claim 1, further comprising at least one first plant part including a first loop-shaped rail and a second plant part including a second loop-shaped rail, said first loop-shaped rail and said second loop-shaped rail being so arranged that the first part of the plant faces the second part of the plant, at a distance that is such as to move the conveying elements from the first plant part to the second plant part.

6. The plant according to claim 1, wherein said plurality of processing stations further comprises a shearing and welding station in which from a sheet of aluminium or of a multilayered material including at least one layer of aluminium, closing discs are sheared, one for each capsule.

7. The plant according to claim 1, wherein said plurality of processing stations further comprises a shearing and welding station in which disc-shaped filters are sheared from a sheet of filter material, one for each capsule, which are subsequently inserted into respective capsules and welded inside thereof.

8. The plant according to claim 1, wherein at least one station of said processing stations is modular and includes processing devices and a movable frame to which all the processing devices are fitted, and electrical connecting devices are set up to connect the station to an electrical supply network.

9. The plant according to claim 1, wherein at least one of the processing stations comprises a resting element on which said support element is supported, and a lifting element configured to operate a pushing element mounted on said resting element and configured to push the support element upwards against the force of springs means.

10. The plant according to claim 1, wherein said plurality of processing stations further comprises a sucking and cleaning station configured to clean a flange edge of each capsule.

11. The plant according to claim 1, wherein said plurality of processing stations further comprises a weighing station configured to weigh each capsule to check that the product dosed into each capsule is correct.

12. The plant according to claim 1, wherein said plurality of processing stations further comprises an inerting station configured to suck air from inside the capsule and blow an inert gas into the capsule.

13. The plant according to claim 12, wherein said inerting station comprises a plurality of sucking and insufflation devices, each sucking and insufflation device being configured to suck air contained inside a capsule, wherein each sucking and insufflation device includes a plug intended for being inserted into a mouth of a capsule so as to close the capsule, wherein said plug is made of a porous or microperforated material.

14. The plant according to claim 13, wherein the sucking and insufflation devices are operationally associated with a lifting device that includes a plate element, which extends over the entire length of the inerting station, wherein the plate element is connected by a plurality of springs to a membrane lifting element, that can expand upwards, so as to lift the plate element against the action of the springs.

15. The plant according to claim 1, wherein said plurality of processing stations further comprises a shearing and welding station in which closing discs of the capsules are sheared from a sheet of aluminium or of a multilayered material including at least one layer of aluminium, wherein said closing discs are welded on a flange edge of each capsule, to close the capsule hermetically, wherein in said shearing and welding station a seal ring can also be applied to a connecting zone between the flange edge and a side wall of the capsule.

16. The plant according to claim 15, wherein the shearing and welding station comprises a plurality of shearing and welding devices, each of which includes a shearing punch and a concentric welding punch inside the shearing punch, wherein the shearing punch and the welding punch can move together or independently of one another.

17. The plant according to claim 16, wherein said shearing and welding station further comprises an immobilizing plate intended to immobilize, during shearing and welding operations, a film of closing material from which the closing disc is obtained for each capsule.

18. The plant according to claim 17, wherein the immobilizing plate is provided with a through opening through which the shearing punch and the welding punch can pass.

19. A method for processing capsules for preparing beverages including:

providing a processing plant for processing capsules for beverages, wherein the processing plant includes at least one rail, providing conveying elements configured to be movable independently from each other along said at least one rail, wherein said at least one rail and said conveying elements define an electromagnetic conveying system, providing a support element received within each conveying element, the support element defining a cavity and having an upper annular rim onto which an annular flange of the capsule rests when received into the cavity, providing an inlet station configured to introduce capsules into the cavities of the support elements, and an outlet station configured to remove capsules from the support elements, providing a plurality of processing stations arranged along said at least one rail between said inlet station and said outlet station, wherein a preset processing is performed on each capsule in each station of said plurality of processing stations, wherein said plurality of preset processing includes:

dispensing a predetermined quantity of product into each capsule at a dosing station and welding a closing disc on a respective capsule to close the capsule at a welding station, wherein the support element with the received capsule is lifted from the conveying element when the capsule is aligned with the welding station.

20. The method according to claim 19, wherein said conveying elements can be moved in groups along said processing plant, a number of conveying elements in each of said groups being able to be chosen independently of a number of conveying elements in the other groups.

21. The method according to claim 19, wherein said processing plant comprises a plurality of rails arranged adjacent to one another, wherein each conveying element or a group of conveying elements is transferable automatically from one rail to an adjacent rail, without varying substantially a movement speed thereof.

22. The method according to claim 19, further including:

shearing a closing disc from a sheet of aluminium or of a multilayered material including at least one layer of aluminium, inserting the closing disc into a capsule and welding the closing disc to a bottom of the capsule, and/or shearing a disc-shaped filter from a sheet of filter material;

inserting the disc-shaped filter into a capsule and welding the disc-shaped filter into an inside of the capsule.

23. The method according to claim 19, wherein a movement speed of each conveying element is adjustable independently of movement speeds of the other conveying elements and that a gap between two adjacent conveying elements, during a motion of said conveying elements, can be adjusted independently of gaps between other conveying elements that are adjacent to one another.

24. The method according to claim 19, further including providing along said at least one rail accumulating zones for accumulating said conveying elements.

* * * * *